US007703504B2

(12) United States Patent
Ishibashi et al.

(10) Patent No.: US 7,703,504 B2
(45) Date of Patent: Apr. 27, 2010

(54) AIR CONDITIONER AND MANUFACTURING METHOD THEREFOR

(75) Inventors: Akira Ishibashi, Tokyo (JP); Kunihiko Kaga, Tokyo (JP); Riichi Kondou, Tokyo (JP); Takuya Mukouyama, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 512 days.

(21) Appl. No.: 11/628,872

(22) PCT Filed: Mar. 8, 2006

(86) PCT No.: PCT/JP2006/304434

§ 371 (c)(1),
(2), (4) Date: Dec. 8, 2006

(87) PCT Pub. No.: WO2007/017969

PCT Pub. Date: Feb. 15, 2007

(65) Prior Publication Data

US 2008/0282725 A1 Nov. 20, 2008

(30) Foreign Application Priority Data

Aug. 8, 2005 (JP) ..... 2005-229280

(51) Int. Cl.
*F24H 3/06* (2006.01)
*F25D 17/06* (2006.01)
*F25B 39/02* (2006.01)
*B21D 53/06* (2006.01)

(52) U.S. Cl. ..... 165/122; 62/419; 62/426; 62/525; 62/515; 29/890.035

(58) Field of Classification Search ..... 62/525, 62/526, 419, 426, 515; 165/122, 53
See application file for complete search history.

(56) References Cited

U.S. PATENT DOCUMENTS 5,417,279 A * 5/1995 Wada ..... 165/122

(Continued)

FOREIGN PATENT DOCUMENTS

CN 1186221 A 7/1998

(Continued)

OTHER PUBLICATIONS

Supplementary European Search Report issued in Application No. 06 728 753.2, dated Aug. 12, 2008.
Chinese Office Action, Chinese Application No. 2006800005140, dated Feb. 20, 2009.

*Primary Examiner*—William E. Tapolcai
*Assistant Examiner*—Filip Zec
(74) *Attorney, Agent, or Firm*—Buchanan Ingersoll & Rooney PC

(57) ABSTRACT

A heat exchanger includes fins arranged in parallel with each other with a predetermined spacing along the rotational axis direction of a blower. Heat exchanger tubes are inserted into the fins to form rows along a longitudinal direction of the fins connected to each other along the airflow direction, to form refrigerant channels. A branch portion is provided to connection portions of the heat exchanger tubes to increase or decrease the number of paths in the refrigerant channels. Refrigerant flows through each of the refrigerant channels passing through paths mutually different at least at one portion between the refrigerant inlet and the refrigerant outlets, flows along one direction from the windward-side row to the leeward-side row, or from the leeward-side row to the windward-side row in the airflow direction, in sequence between rows. One-path portion is provided in the most windward-side row heat exchanger tubes. The fins are in close contact with a refrigerant outlet case when the heat exchanger is operated as a condenser, and a connection piping are thermally separated by separation means.

12 Claims, 20 Drawing Sheets

U.S. PATENT DOCUMENTS

| | | | | | |
|---|---|---|---|---|---|
| 5,660,056 | A | * | 8/1997 | Arai et al. | 62/324.6 |
| 5,896,921 | A | * | 4/1999 | Lee | 165/149 |
| 5,983,998 | A | * | 11/1999 | Kim | 165/150 |
| 6,142,220 | A | | 11/2000 | Motegi et al. | |
| 6,363,967 | B1 | * | 4/2002 | Tanaka et al. | 137/597 |

FOREIGN PATENT DOCUMENTS

| | | | |
|---|---|---|---|
| EP | 1 031 801 | | 8/2000 |
| EP | 1 085 280 | | 3/2001 |
| JP | 62-85819 | U | 6/1987 |
| JP | 02-290493 | | 11/1990 |
| JP | 02-290493 | A | 11/1990 |
| JP | 07-027359 | A | 1/1995 |
| JP | 07-071841 | A | 3/1995 |
| JP | 08-159502 | A | 6/1996 |
| JP | 10-160288 | | 6/1998 |
| JP | 10-176837 | A | 6/1998 |
| JP | 2000-065445 | A | 3/2000 |
| JP | 2000-274804 | | 10/2000 |
| JP | 2000-274804 | A | 10/2000 |
| JP | 2001-082759 | A | 3/2001 |
| JP | 2002-061863 | A | 2/2002 |
| JP | 2002-156171 | A | 5/2002 |
| JP | 2002-206766 | A | 7/2002 |
| JP | 2003-222384 | A | 8/2003 |
| JP | 2005-083715 | A | 3/2005 |

* cited by examiner (HEAT EXCHANGER CAPABILITY IN HEATING OPERATION UNDER PERFECT COUNTERCURRENT CONDITION) / (HEAT EXCHANGER CAPABILITY IN HEATING OPERATION UNDER NON-PERFECT COUNTERCURRENT CONDITION)

AIR CONDITIONER AND MANUFACTURING METHOD THEREFOR

TECHNICAL FIELD

The present invention relates to an air conditioner that performs a heat exchange between fluids such as a refrigerant and air by using a fin-tube type heat exchanger, and a manufacturing method for the same.

BACKGROUND ART

Among indoor units of conventional air conditioners, some have been of a type in which refrigerant channels in its heat exchanger are constituted of two paths and in which the refrigerant has been circulated so that the balance of heat exchange amount can be kept, allowing for wind speed (refer to Patent Document 1 for example). Also, some have been of a type in which refrigerant channels in its heat exchanger are constituted of two paths and in which an expansion valve is provided midway along a refrigerant channel to allow a dehumidifying operation (refer to Patent Document 2 for example). Moreover, some have been of a type in which refrigerant channels in its heat exchanger are constituted of two paths and in which a balance of the amounts of a refrigerant flowing through mutually different paths is kept (refer to Patent Document 3 for example). Furthermore, some have been of a type in which the path number of refrigerant channels in its heat exchanger is increased from 2 to 4 and in which an increase in pressure loss is suppressed by increasing the area of the refrigerant channels in the evaporation process of the refrigerant (refer to Patent Document 4 for example).

[Patent Document 1]

Japanese Unexamined Patent Application Publication No. 8-159502 (pp. 2 to 3, FIG. 2)

[Patent Document 2]

Japanese Unexamined Patent Application Publication No. 2001-82759 (pp. 3 to 4, FIG. 2)

[Patent Document 3]

Japanese Unexamined Patent Application Publication No. 7-27359 (pp. 2 to 3, FIG. 2)

[Patent Document 4]

Japanese Unexamined Patent Application Publication No. 7-71841 (pp. 2 to 3, FIG. 1)

DISCLOSURE OF INVENTION

Problems to be Solved by the Invention

In the conventional air conditioner with refrigerant channels of a two-path configuration, the overall refrigerant flow speed is smaller than in refrigerant channels of a one-path configuration, and the heat transfer coefficient is small particularly in a portion where the refrigerant is in a supercooled state. This has raised a problem in that a large heat exchanger capability cannot be obtained. Furthermore, in an air conditioner of a type in which its refrigerant channel is branched from two paths into four paths, a plurality of refrigerant flow paths is formed between a refrigerant inlet and a refrigerant outlet, but this type has been of such a configuration that, in a portion where a refrigerant flows in heat exchanger tube rows different for each refrigerant channel, there is a part where the refrigerant flows in the mutually opposite directions in a single refrigerant channel, such as from the windward-side row to the leeward-side row, and from the leeward-side row to the windward-side row in the airflow direction. Therefore, in terms of the temperature change in the overall flow, there occurs a portion where a change in air temperature and a change in refrigerant temperature occur in the directions opposite to each other. This has also caused a problem in that a large heat exchanger capability cannot be obtained.

The present invention has been made to solve the above-described problems. An object of the present invention is to improve the heat exchange performance of a heat exchanger and achieve an air conditioner having high energy efficiency. Another object of the present invention is to obtain a method for manufacturing an air conditioner capable of being relatively easily assembled.

Means for Solving the Problems

The present invention is characterized by including a blower for introducing a gas that flows in from an intake port, into a blowoff port; a heat exchanger for exchanging heat between the gas and a refrigerant, the heat exchanger being disposed on the intake side of the blower, heat exchanger tubes disposed in the heat exchanger, the heat exchanger tubes being substantially perpendicularly inserted into a plurality of fins arranged in parallel with each other along the direction of the rotational axis of the blower at a predetermined spacing so as to form rows along the longitudinal direction of the fins, and being connected to each other along the gas flow direction in a plurality of rows, to thereby form refrigerant channels between a refrigerant inlet and a refrigerant outlet; and a branch pipe that is connected to connection portions of the heat exchanger tubes, and that partially increases or decrease the number of paths in the refrigerant channels formed by the heat exchanger tubes, wherein the refrigerant flowing through each of a plurality of the refrigerant channels passing through paths mutually different at least one portion between the refrigerant inlet and the refrigerant outlet, flows along one direction from the windward-side row to the leeward-side row, or from the leeward-side row to the windward-side row in the gas flow direction, in sequence between rows.

Advantages

The air conditioner according to the present invention is configured so that a path is branched off and refrigerant channels are formed, and that the refrigerant passing through each of a plurality of refrigerant channels formed by passing through mutually different paths between a refrigerant inlet and a refrigerant outlet flows along one direction from the windward-side row to the leeward-side row, or from the leeward-side row to the windward-side row in the airflow direction in sequence between rows. Therefore, the changes in air temperature from an intake port to a blowoff port and the changes in refrigerant temperature from the refrigerant inlet to the refrigerant outlet can be made parallel to each other, and heat transfer performance is improved by performing an efficient heat exchange at any portion of a heat exchanger, thereby allowing an air conditioner having high energy efficiency to be achieved.

BEST MODE FOR CARRYING OUT THE INVENTION

First Embodiment

Figure 1:
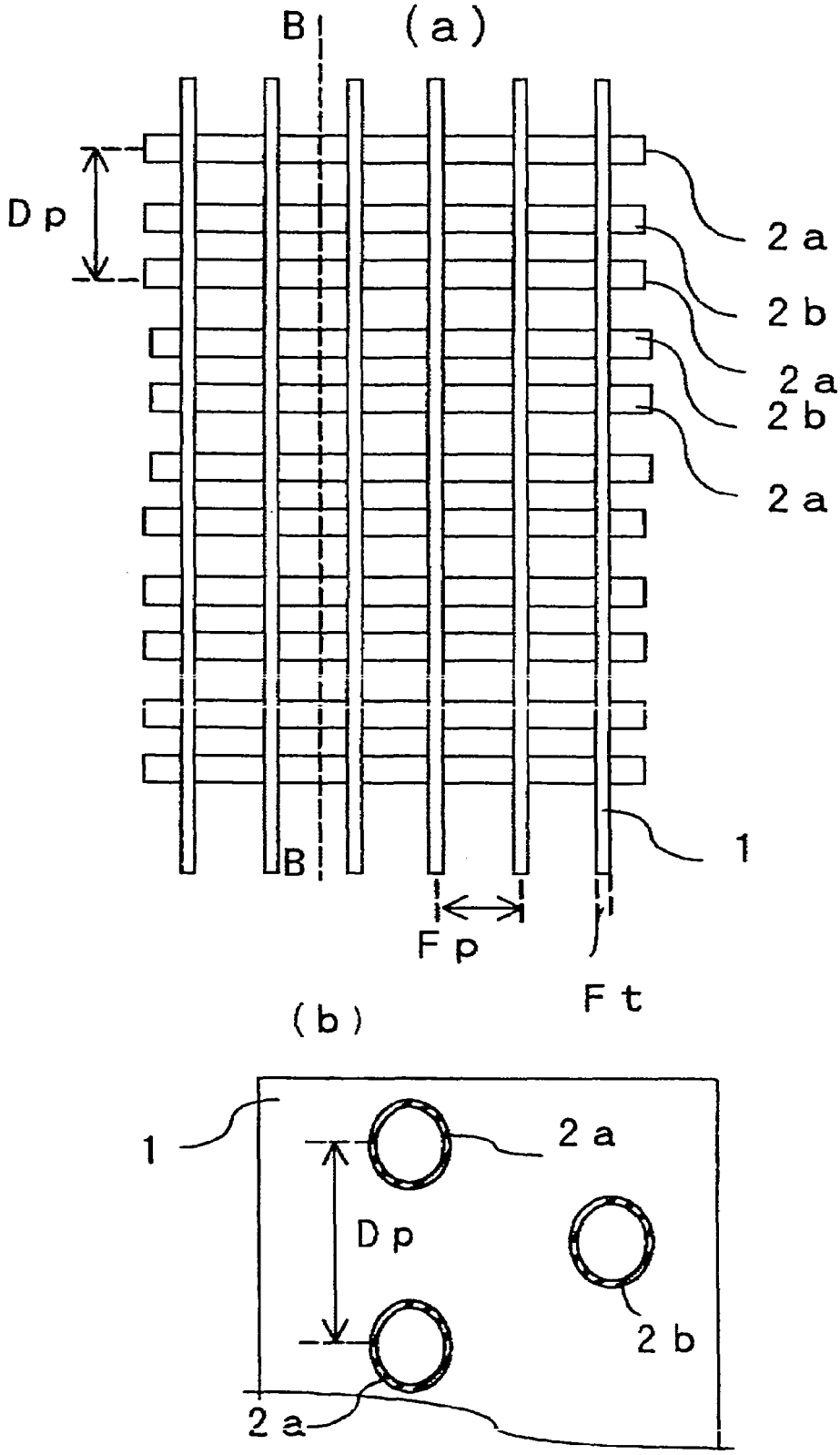
FIGS. 1A and 1B are each an explanatory view showing the inner construction of a heat exchanger according to a first embodiment of the present invention.

Hereinafter, the construction of an air conditioner according to a first embodiment of the present invention will be described. FIGS. 1A and 1B are explanatory views showing the inner construction of a heat exchanger according to the first embodiment of the present invention, wherein FIG. 1A is a front view, and FIG. 1B is a sectional view taken along a line B-B in FIG. 1A. Here, a plurality of fins are arranged substantially in parallel to each other with a predetermined spacing (fin pitch) Fp. Heat exchange tubes 2 are substantially perpendicularly inserted into the fins 1, and fixed. Typically, the rows of heat exchanger tubes 2 extend along the longitudinal direction of the fins 1, being provided as a plurality of rows in the airflow direction. Here, FIG. 1A illustrates rows of heat exchanger tubes 2 having two rows of heat exchanger tubes 2*a* and 2*b*. When air flows in the direction perpendicular to the plane of FIG. 1A, the air exchanges heat with a refrigerant flowing through the heat exchanger tube 2 so that the temperature of the air increases or decreases depending on heat or cold of the refrigerant. The fins 1 are in close contact with the heat exchanger tubes 2, and have the function of increasing a heat transfer area. Here, when the direction of heat exchanger tubes 2 that are adjacent to each other in one row is referred to as a "stage", the heat exchanger is constructed so as to have: a stage interval (a stage pitch) Dp that is the distance between the centers of heat exchanger tubes adjacent in the stage direction of the heat exchanger; the distance between fins 1 (fin pitch) Fp; and a fin thickness Ft, as shown in FIG. 1. In this embodiment, for example, the fin pitch Fp=0.0012 m, fin thickness Ft=0.000095 m, and stage pitch Dp=0.0204 m.

Figure 2:
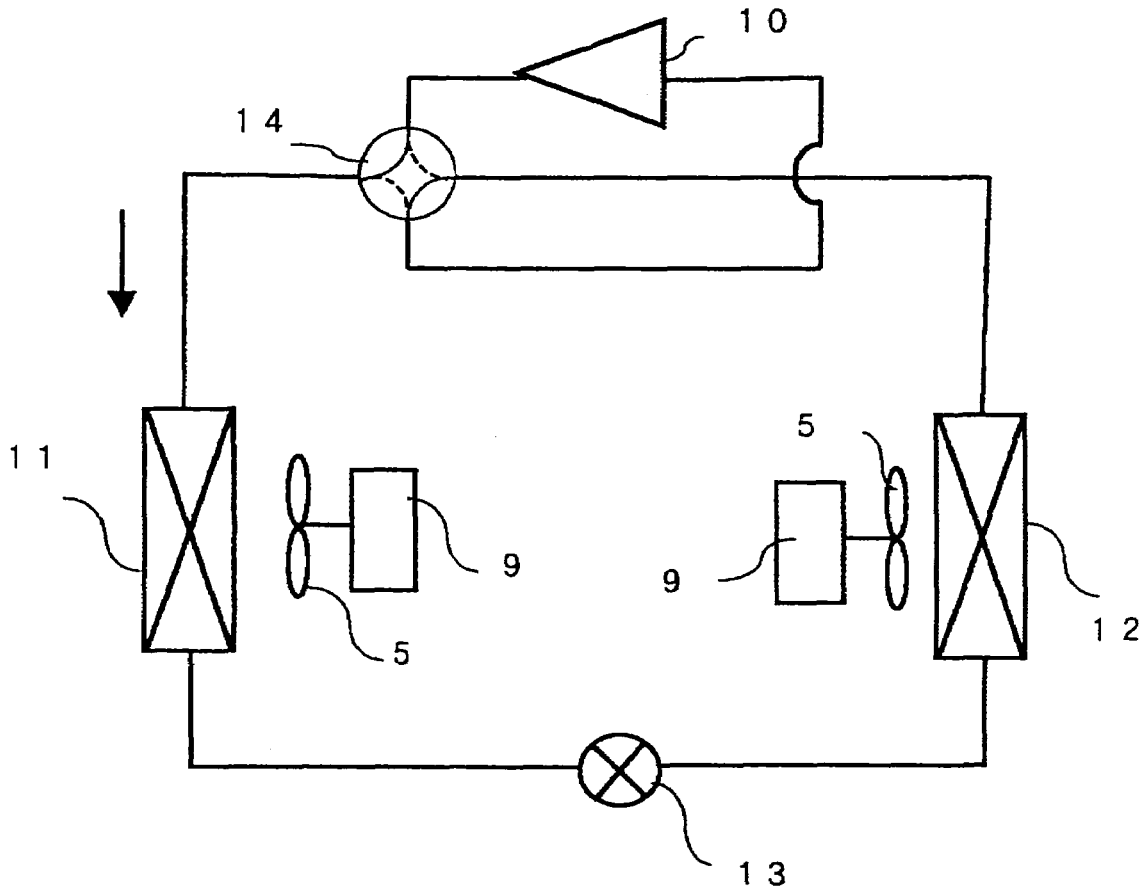
FIG. 2 is a refrigerant circuit view showing an example of refrigerant circuit of an air conditioner according to the first embodiment of the present invention.

FIG. 2 is a refrigerant circuit view showing an example of refrigerant circuit of an air conditioner according to the first embodiment of the present invention, wherein an air conditioner having cooling and heating capabilities is illustrated. The refrigerant circuit shown in FIG. 2 is constructed by connecting a compressor 10, an indoor heat exchanger 11, a throttle valve 13, an outdoor heat exchanger 12, and a channel switching valve 14 with connecting pipings. A refrigerant such as carbon dioxide is circulated in the piping. In the indoor heat exchanger 11 and the outdoor heat exchanger 12, a heat exchange is made between the refrigerant and air blown by a blower 5 rotationally driven by a blower motor 9. The indoor heat exchanger 11 and the outdoor heat exchanger 12 are each a heat exchanger having the basic construction shown in FIG. 1.

An arrow in FIG. 2 indicates the direction of the flow of the refrigerant during heating. In this refrigeration cycle, a refrigerant gas that has reached a high temperature and high pressure by being compressed by the compressor 10, exchanges heat with indoor air and condenses into a liquid refrigerant or an air/liquid two-phase refrigerant at a low temperature and high pressure. At this time, a heating to warm the indoor air is performed. Thereafter, a pressure reduction is performed by, the throttle valve 13, and the refrigerant gas becomes a liquid refrigerant or an air/liquid two-phase refrigerant at a low temperature and low pressure, to thereby flow into the outdoor heat exchanger 12. Here, the liquid refrigerant or an air/liquid two-phase refrigerant exchanges heat with outdoor air to thereby evaporate into a refrigerant gas at a high temperature and low pressure, and is circulated again to the compressor 10.

On cooling operation, the connection of the channel switching valve 14 is switched as indicated by dotted lines shown in FIG. 2, and thereby the refrigerant is circulated in the order of the compressor 10→outdoor heat exchanger 12→throttle device 13→indoor heat exchanger 11→compressor 10. Thereby, the refrigerant is condensed in the outdoor heat exchanger 12 and evaporated in the indoor heat exchanger 11. A cooling operation for cooling the indoor air is performed when the refrigerant evaporates in the indoor heat exchanger 11.

Usually, the indoor heat exchanger 11, and the blower 5 and blower motor 9 are stored in a single cabinet, and disposed indoors as an indoor unit, and other portions, i.e., the compressor 10, channel switching valve 14, outdoor heat exchanger 12, and the blower 5 and blower motor 9 are disposed outdoors as an outdoor unit, wherein the indoor unit and the outdoor unit are connected by refrigerant piping.

The energy efficiency of an air conditioner is represented by the following expressions:

heating energy efficiency=[indoor heat exchanger (condenser) capability]/[total input]

cooling energy efficiency=[indoor heat exchanger (evaporator) capability]/[total input]

That is, an improvement in the heat exchange capabilities of the indoor heat exchanger 10 and outdoor heat exchanger 12 allows the implementation of an air conditioner having high energy efficiency. In this embodiment, it is intended to improve the capability of the heat exchanger, especially that in the indoor unit.

Figure 3:
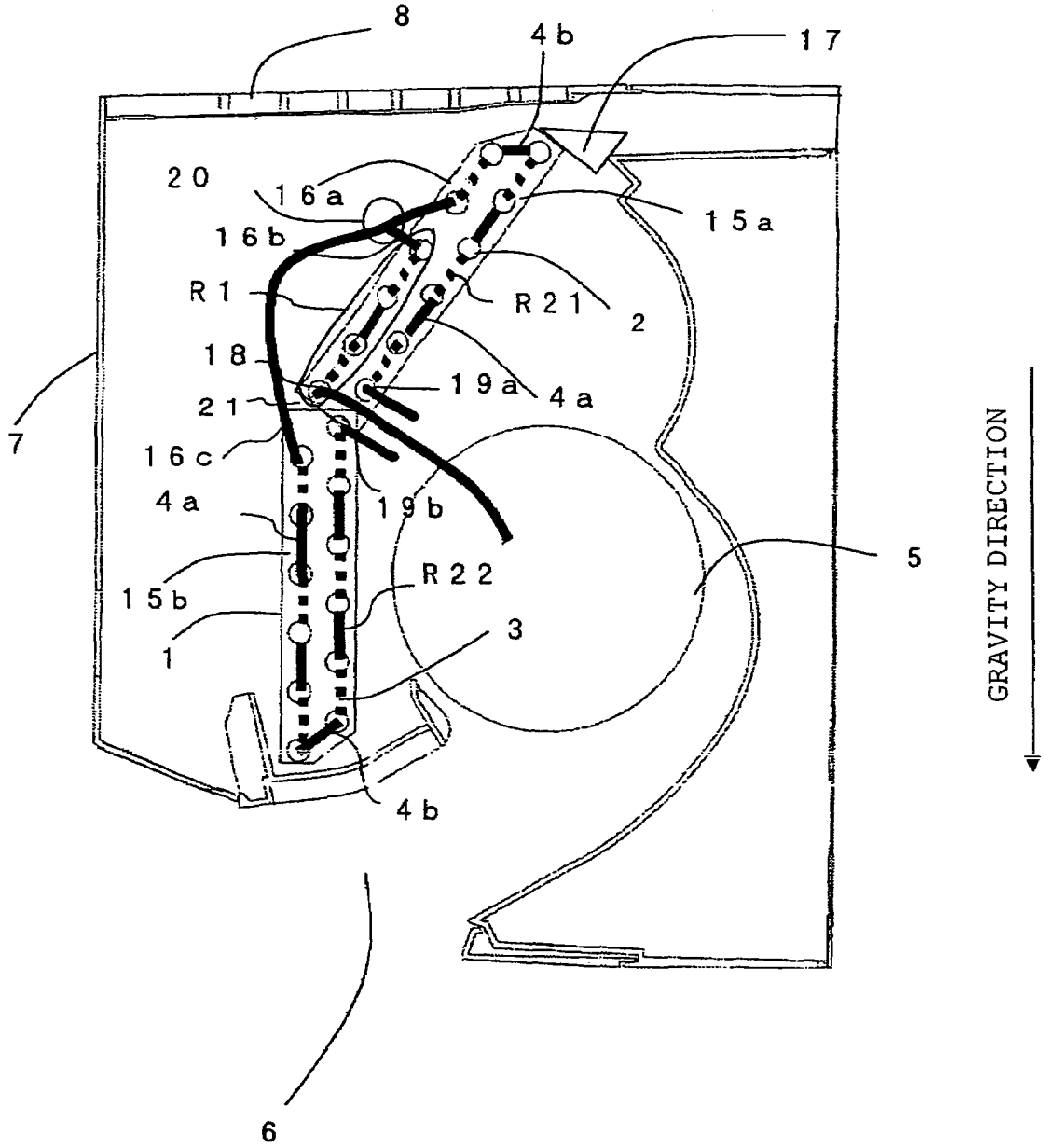
FIG. 3 is a constructional side view of an indoor unit of the air conditioner according to the first embodiment of the present invention.

FIG. 3 is a constructional side view of an indoor unit of the air conditioner having the heat exchanger according to this embodiment of the present invention. This indoor unit is installed onto the surface of an indoor wall at the right side of the cabinet, in FIG. 3. The air conditioner according to this embodiment is, for example, 0.3 m high, and 0.225 m deep. The heat exchanger 15 is divided into two in the gravity direction, and composed of an upper heat exchanger 15*a* and a lower heat exchanger 15*b*. The heat exchanger tubes 2 in the heat exchangers 15*a* and 15*b* form two rows, i.e., rows on the windward side and leeward side along the direction of airflow that flows from the intake port 8 to the blowoff port 6, wherein six stages of heat exchanger tubes form one row. The heat exchangers 15*a* and 15*b* form an angle therebetween so as to form a chevron shape, and are arranged on the side of intake port 8 so as to surround the blower 5. In the gap between the cabinet on the rear surface side and the upper heat exchanger 15*a*, there is provided an insulation 17 for preventing airflow passing through the aforementioned gap. Reference numerals 18; and 19*a* and 19*b* denote inlets and outlets of the refrigerant to/from the heat exchanger 15, respectively. Here, 18 denotes a most windward-side row refrigerant port provided in a most windward-side row heat exchanger tube, and 19*a* and 19*b* denote two most leeward-side row refrigerant ports provided in most leeward-side row heat exchanger tubes, each of these ports being located at a central portion in the longitudinal direction of the fins 1.

Figure 4:
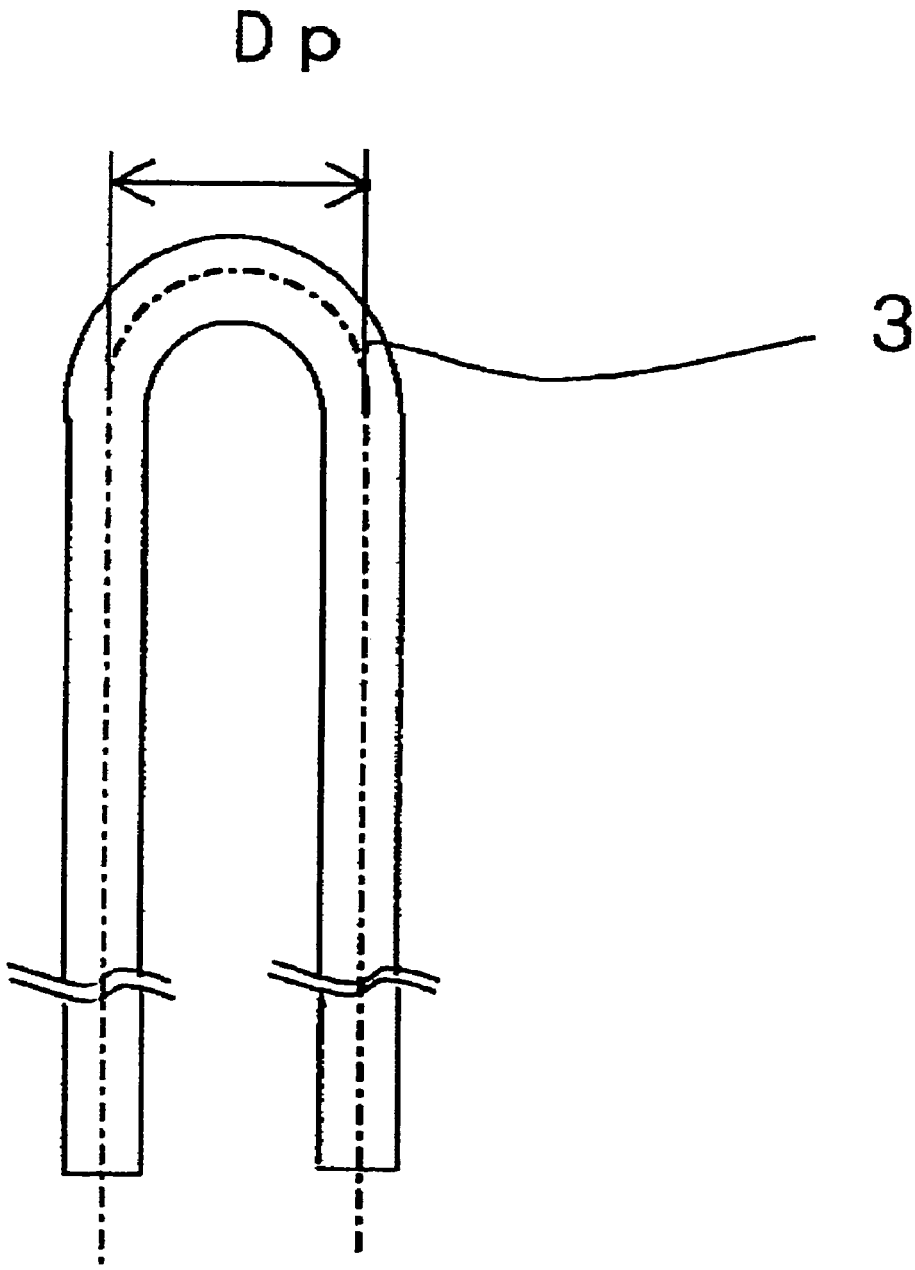
FIG. 4 is a front view of a hairpin according to the first embodiment of the present invention.

The fin width L of the upper heat exchanger 15*a* and that of the lower heat exchanger were equalized, and L=0.0254 m was used for example. The heat exchanger tubes 2 are each bended into a U-shape in a state 3 as shown in FIG. 4 (hereinafter, this state is referred to as a hairpin 3), and inserted into holes previously provided in the fins 1, and the heat exchanger tubes 2 are each bought into close contact with the fins 1 by expanding the heat exchanger tubes 2, for example. On the side surface opposite to the side where the hairpins 3 have been inserted, U-bends 4*a* and 4*b* and a three-way bend 16 are connected to the ends of the hairpin 3, thereby constituting refrigerant channels. The side surface in FIG. 3 illustrates a side surface where the U-bends 4*a* and 4*b* and the three-way bend 16 are connected. Because the hairpin 3 is inserted from the opposite side surface to the side surface of FIG. 3 and fixed, U-shaped hairpin is formed between heat exchanger tubes 2 at dotted line portions. The U-bends 4*a* and 4*b* are different from each other in length, and the U-bend 4*a* is piping for connecting heat exchanger tubes in the same row along the stage direction while the U-bend 4*b* is piping for connecting heat exchanger tubes in mutually different rows along the row direction.

The heat exchanger 15 is divided into two of the upper heat exchanger 15*a* and the lower heat exchanger 15*b*, and the lower end of the upper heat exchanger 15*a* and the upper end of the lower heat exchanger 15*b* are thermally separated. That is, separation means 21 is constructed that thermally separates the heat exchanger 15 in a vertical direction by a space occurring in a division portion in the longitudinal direction of the fins 1 because of the heat exchanger 15 being divided. While the fin width L of the upper heat exchanger 15*a* and that of the lower heat exchanger 15*b* was equalized, it is desirable to equalize them when allowing for heat exchanger performance. In some case, however, their widths could not be equalized due to manufacturing reasons. However, even if there is a width difference of, e.g., about ±1 mm between the upper heat exchanger 15*a* and lower heat exchanger 15*b*, their widths can be regarded as equal to each other.

For the front portion of the cabinet, e.g., a front panel 7 is used that does not allow air to penetrate. By rotationally driving the blower 5 by the blower motor 9, air is sucked in from the intake port 8 disposed at an upper portion of the indoor unit, and after having been introduced into a wind course, the air is blown off from the blowoff port 6 disposed at a lower portion of the indoor unit. The plurality of fins 1 constituting the heat exchanger 15 is arranged in parallel at a predetermined spacing (fin pitch Fp) along the rotational axis direction of the blower 5.

Figure 5:
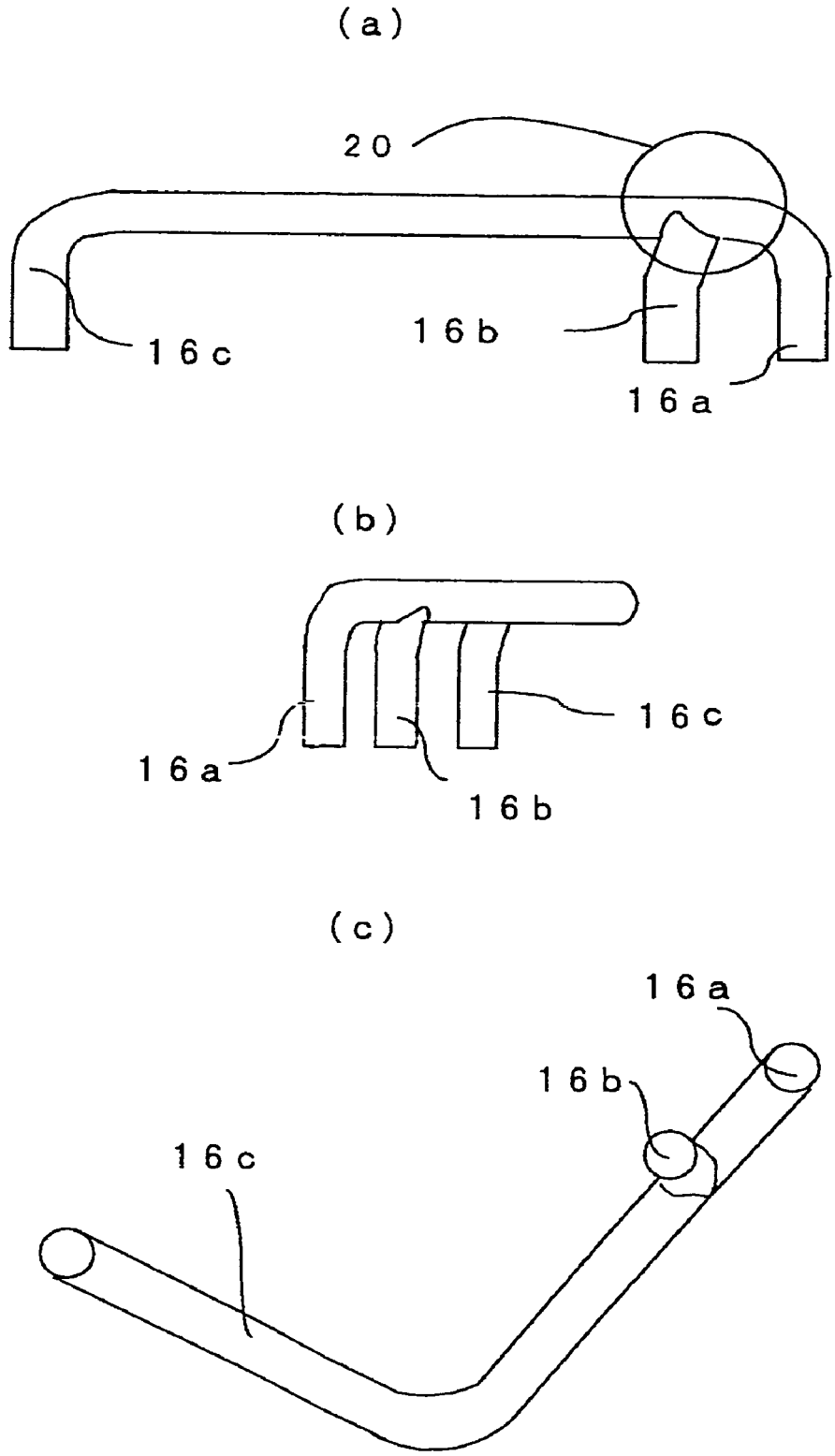
FIGS. 5A, 5B, and 5C, respectively, are a front view, a right side view, and a bottom view of a branch pipe according to the first embodiment of the present invention.

FIGS. 5A, 5B, and 5C, respectively, are a front view, a right side view, and a bottom view of a three-way bend 16 as an example of a branch pipe provided in a branch portion in a refrigerant circuit. Here, reference numeral 20 denotes a branch portion. The three-way bend 16 has, for example, three connection portions for connecting a branch portion 20 between one path and two paths to ends of heat exchanger tube 2, namely, hairpins 3. The channel from the branch portion 20 divided into three ways to the heat exchanger tubes 2 is referred to as a connection piping portion, which is constituted of shorter connection pipings 16*a* and 16*b*, and a longer connection piping 16*c*. Here, the connection piping 16*b* is connected to a heat exchanger tube 2 in a one-path portion, and the connection pipings 16*a* and 16*c* are connected to heat exchanger tubes 2 in the two-path portions.

Here, as shown in FIG. 3, the three-way bend 16 is connected to the heat exchanger tubes 2 across the upper heat exchanger 15*a* and the lower heat exchanger 15*b*. Specifically, the longer connection piping 16*c* is disposed on the lower side in the gravity direction, while the shorter connection piping 16*a* and 16*b* are disposed on the upper side in the gravity direction. Here, the end of the longer connection piping 16*c* is connected to the lower heat exchanger 15*b*, while the end of each of the shorter connection piping 16*a* and 16*b* is connected to the upper heat exchanger 15*a*. As a refrigerant channel, the longer connection piping 16*c* is connected to one path out of two-path portions. One of the shorter connection piping 16*a* and 16*b* is connected to the one-path portion and the other of them is connected to the remaining path out of the two-path portions.

In this embodiment, there is provided a construction having a branch portion 20 allowing the path number of each refrigerant channel to partially increase or decrease, and the heat exchanger performance significantly varies depending upon how the refrigerant channels are formed in the heat exchanger 15 accommodated in a limited space. If, with no branch portion 20 provided, the number of paths from the refrigerant inlet to the refrigerant outlet is the same, a refrigerant channel can be relatively easily formed, but if a branch portion 20 is provided, a plurality of refrigerant channels is formed, thereby resulting in a complicated construction. It is not easy to arrange so that heat exchange with air is efficiently performed in all of the plurality of refrigerant channels that passes though paths mutually different at least one portion. Here, an improvement in heat exchange performance is attempted by providing a branch portion 20, and researches are conducted in refrigerant flows and airflows, including conditions of the refrigerant flowing through a plurality of refrigerant channels formed between the refrigerant inlet and refrigerant outlet and the positional relationship between the airflow and the refrigerant channel. Thus, a construction to perform an efficient heat exchange by a heat exchanger is provided, thereby acquiring an air conditioner having a sufficient heat exchange performance. Particularly in the fin-tube type heat exchanger, heat exchanger tubes 2 that extend in the direction of the rotational axis of the blower 5 are formed in a plurality of rows, and hence, the construction of refrigerant circuits is determined based on how the end of each of the heat exchanger tubes 2 is connected on one side surface of the heat exchangers. Under such a condition, it is required to obtain an air conditioner having a heat exchange performance as excellent as possible.

As described with reference to FIG. 2, when an air conditioner has a cooling function and heating function, the heat exchanger is used as either a condenser or an evaporator. Then, in the refrigerant circuit in the heat exchanger 15, the positional relationship of the refrigerant inlet and the refrigerant outlet is reversed between the cases when the heat exchanger 15 is used as a condenser and when it is used as an evaporator. Hereinafter, description will be made of the case where the air conditioner is operated in a cooling operation mode and the heat exchanger is operated as an evaporator.

Figure 6:
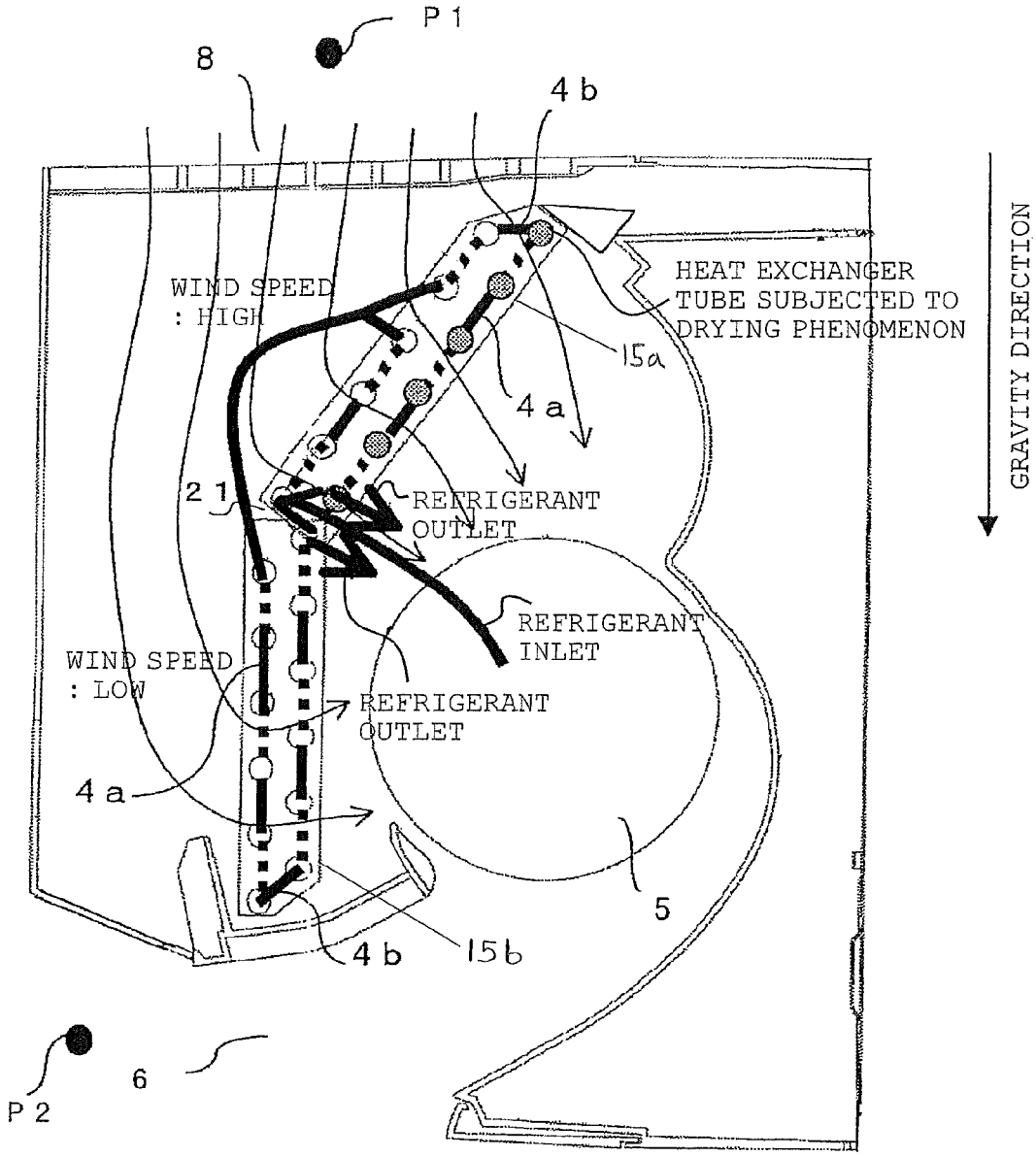
FIG. 6 is an explanatory view showing refrigerant flows and airflows in the case when heat exchangers according to the first embodiment of the present invention is used as an evaporator.
Figure 7:
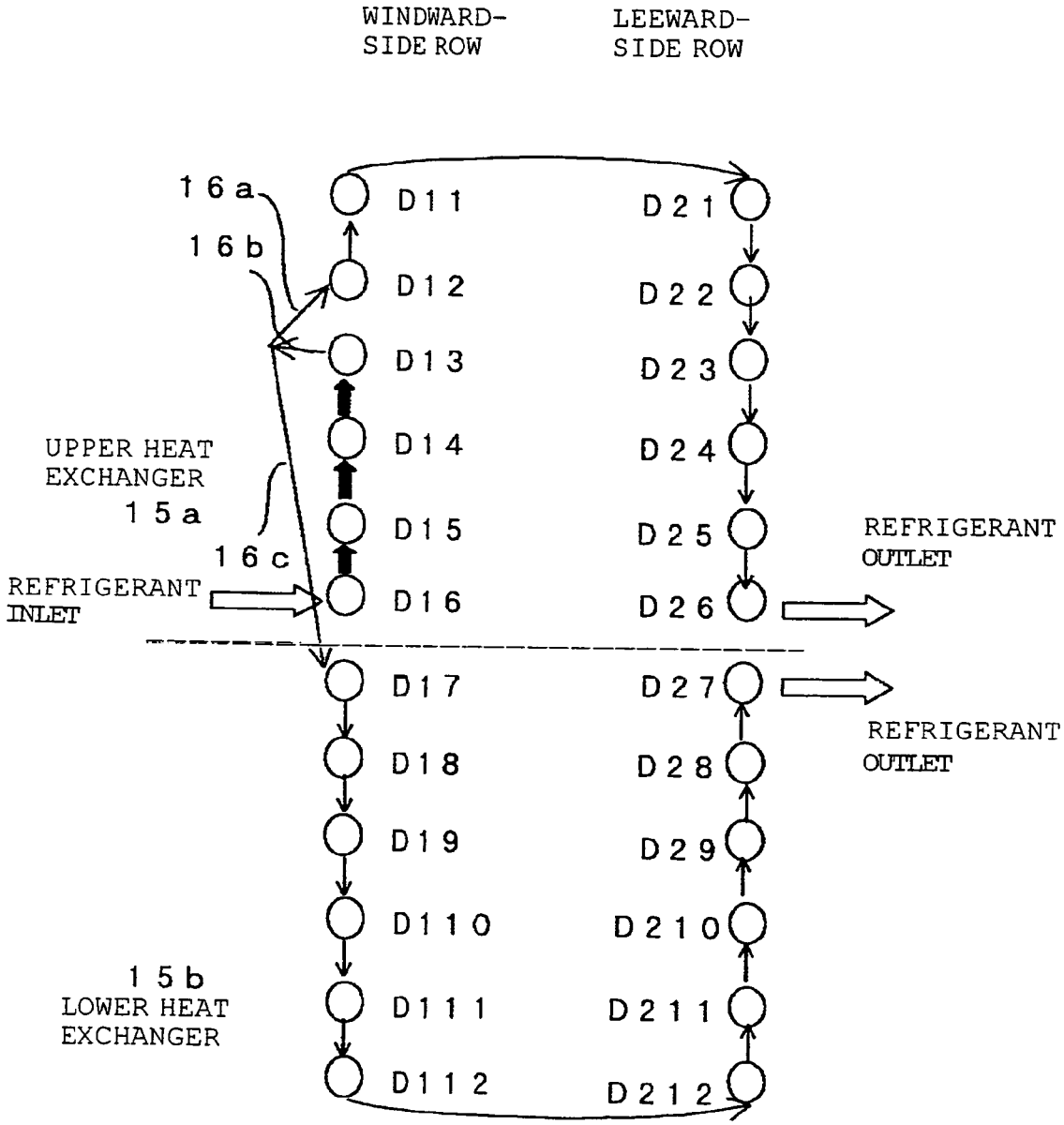
FIG. 7 is an explanatory view schematically showing a connection state of heat exchanger tubes according to the first embodiment of the present invention.

FIG. 6 is an explanatory view showing refrigerant flows and airflows in the case when the heat exchanger according to this embodiment is used as an evaporator, and FIG. 7 is an explanatory view schematically showing a connection state of heat exchanger tubes. When the heat exchanger 15 is used as evaporator, the most windward-side row refrigerant port 18 is assumed to be the refrigerant inlet, and the most leeward-side row refrigerant ports 19*a* and 19*b* are assumed to be the refrigerant outlet.

Under the rotation of blower 5, air having flowed-in from the intake port 8 flows between the fins 1 of the heat exchanger 15 as shown in FIG. 6, and after having made heat exchange with the refrigerant flowing through the heat exchanger tubes 2, flows out from the blowoff port 6. Here, since an air-impermeable fixed panel is used as the front panel 7, the airflow in the indoor unit is high in wind speed in the upper portion of the heat exchanger 15, and low in wind speed in the lower portion thereof. Heat exchanger tubes indicated by dark circles in the upper heat exchanger 15*a* in FIG. 6 are a portion where a refrigerant flowing inside the tubes has a possibility of entering a dried state, and the portion herein is assumed to be equivalent in length to several, e.g., six heat exchangers from the refrigerant outlet side. Similarly, in the lower heat exchanger 15*b* portion equivalent in length to several heat exchangers from the refrigerant outlet side also, the refrigerant has a possibility of entering a dried state. In FIG. 7, each heat exchanger tube is identified by a row number and an order from above. For example, a heat exchanger tube D11 denotes a first heat exchanger tube from above in the windward-side row, and a heat exchanger tube D21 denotes a first heat exchanger tube from above in the leeward-side row. Here, the refrigerant inlet is assumed to be a sixth heat exchanger tube D16 in the windward-side row, while the refrigerant outlets are assumed to be sixth and seventh heat exchanger tubes D26 and D27 in the leeward-side row.

Figure 8:
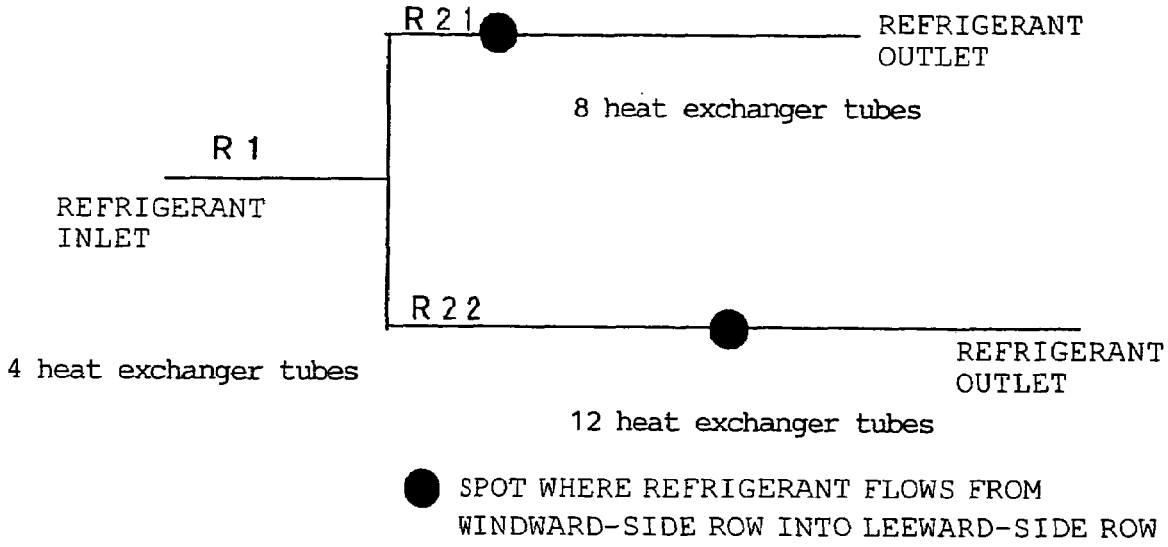
FIG. 8 is an explanatory view showing the construction of refrigerant paths according to the first embodiment of the present invention.

FIG. 8 is an explanatory view showing the construction of refrigerant paths. For example, in the construction according to this embodiment, the refrigerant inlet is connected to a one-path portion R1, and the refrigerant flows through the one-path portion R1 equivalent in length to four heat exchanger tubes. The R1 branches into two-path portions R21 and R22. Here, the R21 is equivalent in length to eight heat exchanger tubes, and the R22 is equivalent in length to twelve heat exchanger tubes. The R21 and R22 are connected to the refrigerant outlet. Black circles in the two-path portions R21 and R22 each indicate a portion connected from a heat exchanger tube in the windward-side row to a heat exchanger tube in the leeward-side row.

When the heat exchanger 15 is operated as an evaporator, in the refrigerant inlet of the heat exchanger 15, a refrigerant flows in a two-phase state in which the percentage of liquid is higher than that of gas, and as the refrigerant flows in the heat exchanger tubes 2, it evaporates so that the proportion of gas gradually increases. Upon exceeding the saturation state, the refrigerant enters an overheated state and flows to the refrigerant outlet. The reason why a one-path is provided in the vicinity of the refrigerant inlet is because, when the heat exchanger 15 is operated as an evaporator, the provision of a one-path produces a large effect. In this respect, discussion will be given below. In the case of an evaporator, when comparing the one-path portion R1 having refrigerant inlet and the two-path portions R21 and R22 having refrigerant outlet, the one-path portion R1 is larger in pressure loss than the two-path portions R21 and R22. However, the velocity of the flow is lower in the portion where the percentage of the gas in the two-phase refrigerant is lower than that in the portion where the percentage of the gas is higher. As a result, even if the portion where the percentage of the gas is lower in the vicinity of the refrigerant inlet, is composed of the one-path portion R1, pressure loss does not become so large, in comparison with the case where the portion with a higher velocity of the flow is constituted of one-path configuration. Furthermore, by branching the refrigerant channel, through which the refrigerant in a two-phase state flows, into two-path portions R21 and R22, a reduction in pressure loss is achieved. The reduction in pressure loss in the two-path portion allows a burden upon the compressor 10 to be reduced.

Figure 9:
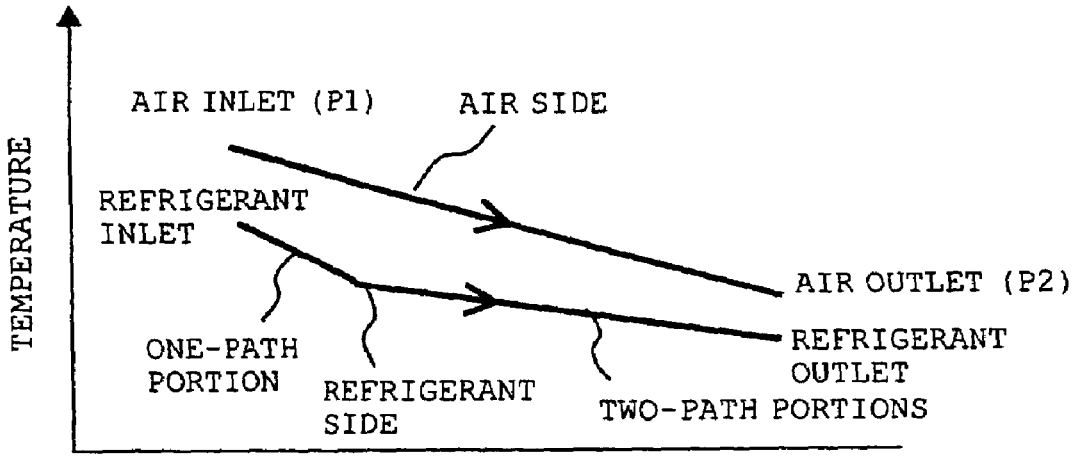
FIG. 9 is a graph showing changes in refrigerant temperature along the direction of refrigerant flow, and changes in air temperature along the direction of airflow, according to the first embodiment of the present invention.

FIG. 9 is a graph showing changes in refrigerant temperature along the direction of refrigerant flow, and changes in air temperature along the direction of airflow, according to the heat exchanger 15 configured as shown in FIGS. 6 to 8. Here, the abscissa axis denotes a position in the flow direction of air or a refrigerant, and the ordinate axis denoted temperature. Regarding the refrigerant side, the temperature of refrigerant flowing into the heat exchanger tube D16 is assumed to be a refrigerant inlet temperature, and the temperature of refrigerant flowing out from the heat exchanger tubes D26 and D27 is assumed to be a refrigerant outlet temperature. Over the course of time, the refrigerant in a gas/liquid two-phase state gradually evaporates, and enters a saturation state or a somewhat overheated state. Here, under the pressure reduction due to pressure loss in the tubes, the refrigerant temperature decreases as the refrigerant moves from the inlet to the outlet. On the other hand, regarding air side, letting the vicinity of a black circle P1 in FIG. 6 be an air inlet, and letting the vicinity of a black circle P2 in FIG. 6 be an air outlet, the refrigerant is cooled down by the heat exchanger 15 while it is flowing from the inlet P1 to the outlet P2, and thus the air temperature decreases from the inlet P1 toward the outlet P2.

The details of flows of refrigerant will be discussed below.

As shown in FIG. 7, the refrigerant that has flowed in from the lowest heat exchanger tube D16 in the windward-side row in the upper heat exchanger 15*a* passes through a one-path portion D16 to D13 in the upper heat exchanger 15*a*, and after having flowed into the three-way bend 16, it is divided into two paths by this branch portion. The one shorter connection piping 16*a* is connected to the heat exchanger tube D12 in the upper heat exchanger 15*a*. When the refrigerant flows from a heat exchanger tube D11 to a heat exchanger tube D21, it flows into the leeward-side row. Then, the refrigerant passes through the D21 to D26 and flows to the refrigerant outlet. That is, as shown in FIG. 8, the refrigerant passes through the one-path portion R1 and the two-path portion R21 between the refrigerant inlet and the refrigerant outlet, i.e., it flows through the heat exchanger tubes 2 equivalent in length to twelve heat exchanger tubes 2. Here, the channel between the refrigerant inlet and the refrigerant outlet is referred to as "upper-side refrigerant channel".

The other longer connection piping 16*c* in the pipings divided into two paths at the branch portion of the three-way bend 16 is connected to the heat exchanger tube D17 in the lower heat exchanger 15*a*. The refrigerant passes through the heat exchanger tubes D17 to D112, and flows into the leeward-side row when flowing into the heat exchanger tube 212, then flowing to the refrigerant outlet through the D212 to D27. That is, as shown in FIG. 8, the refrigerant passes through the one-path portion R1 and the two-pass portion R22 between the refrigerant inlet and the refrigerant outlet, i.e., it flows through heat exchanger tubes 2 equivalent in length to sixteen heat exchanger tubes 2. Here, the channel between the refrigerant inlet and the refrigerant outlet is referred to as "lower-side refrigerant channel".

In each of the upper-side refrigerant channel and lower-side refrigerant channel, respective branched refrigerant flows through the hairpins 3 and U-bends 4*a* in the windward-side row, the hairpins 3 and the U-bends 4*a* being each arranged perpendicularly to the airflow direction. Also, the refrigerant flows through a U-bend 4*b* substantially parallel to the airflow direction, the U-bend 4*b* being arranged substantially parallel to the airflow direction. After having flowed through the hairpin 3 and the U-bends 4*a* in the leeward-side row, the refrigerant flows out from the refrigerant outlet 19*a* and 19*b*. Thus, the refrigerant channel is constructed by connecting heat exchanger tubes so that the refrigerant never flows in a direction opposite to the airflow direction in the overall refrigerant channel.

In the heat exchanger as shown in FIG. 6, the refrigerant flows along one direction from the windward-side row to the leeward-side row in sequence. Consequently, as shown in FIG. 9, the refrigerant temperature monotonously decreases from the refrigerant inlet toward the refrigerant outlet, and this change in refrigerant temperature is substantially parallel to the change in air temperature. As a result, the difference between the air temperature and the refrigerant temperature is always kept constant, and the heat exchange between refrigerant and air is efficiently performed at any portion of the heat exchanger 15, thereby allowing an improvement in heat exchange capability and an achievement of an air conditioner with high energy efficiency.

In FIG. 9, should the change in refrigerant temperature be not in parallel to the change in air temperature, and the changes in the refrigerant temperature and in the air temperature be significantly apart from each other in part and close to each other in part, the temperatures of the refrigerant and air would become too close to each other in the portion where they are close to each other, so as to make a heat exchange therebetween impossible. This results in a deterioration of heat exchange capability. In contrast, if the arrangement is such that the changes in air temperature and in refrigerant temperature is made parallel, the heat exchange capability can be enhanced. Here, regarding the difference of temperature between the change in air temperature and the change in refrigerant temperature, the smaller the difference, the better is the heat transfer coefficient; and the larger the difference, the higher is the heat exchange capability. By at least arranging the changes in air temperature and in refrigerant temperature so as to be parallel to each other, it is possible to enhance the heat exchange capability and achieve an air conditioner with high energy efficiency.

As shown in FIG. 8, if the arrangement is such that a spot (indicated by a black circle) where the refrigerant flows from the first windward-side row into the second leeward-side row exists at only a single location for every refrigerant channels, the refrigerant flowing through both of the upper-side refrigerant channel and the lower-side refrigerant channel flows along one direction from the windward-side heat exchanger tubes to the leeward-side heat exchanger tubes in sequence. Consequently, the temperature on the refrigerant side monotonously decreases from the refrigerant inlet toward the refrigerant outlet, and the change in refrigerant temperature become substantially parallel to the change in air temperature.

As described above, the present air conditioner has branch pipes 16 for partially increasing or decreasing the path number of the refrigerant channel by the heat exchanger tubes 2, and is configured so that the refrigerant flowing through each of the plurality of refrigerant channels, which are formed so as to pass through paths mutually different at least in one portion between the refrigerant inlet 18 and the refrigerant outlet 19*a* and 19*b*, flows along one direction from the windward-side row to the leeward-side row in the airflow direction in sequence between rows. Thereby, heat transfer performance is improved by an efficient heat exchange being performed at any portion of the heat exchanger, and thus an air conditioner with high energy efficiency can be achieved.

The construction of the refrigerant channels shown here are only an example, and not restrictive. In the heat exchanger 15 used as an evaporator, any one of the windward-side row heat exchanger tubes is employed as a refrigerant inlet, and any two of the leeward-side row heat exchanger tubes are employed as a refrigerant outlet. The one-path portion R1 is assumed to be only in a portion of the windward-side row heat exchanger tubes without extending over a plurality of rows. In all of the plurality of refrigerant channels constructed, the refrigerant has only to flow along one direction from the windward-side row to the leeward-side row in sequence without flowing back in the opposite direction (leeward-side row→windward-side row) between rows. Thereby, the changes in air temperature and in refrigerant temperature can be made substantially parallel to each other, and heat exchange can be efficiently performed at any portion in the heat exchanger 15, resulting in an enhanced heat transfer performance.

In each of the plurality of refrigerant channels, it is recommended that the length of heat exchanger tubes arranged from the spot, at which the refrigerant flows into the leeward-side row, up to the refrigerant outlet should be larger to some extent. When the refrigerant flowing through a refrigerant channel has entered an overheated state in the vicinity of refrigerant outlet, there occurs a "drying" phenomenon in which refrigerant temperature gets close to air temperature, thereby resulting in reduced heat transfer performance. Specifically, once the refrigerants passing inside of a windward-side row heat exchanger tubes and a leeward-side row heat exchanger tubes situated in the vicinity of some air flow passage have both entered an overheated state, the air, with a high temperature and a high humidity flows into the blower 5 just as it is, substantially without being cooled down. For example, when the refrigerant flowing inside both of the heat exchanger tubes D11 and D21 in the upper heat exchanger 15*a* is in an overheated state, air flowing through these portions flows into the blower 5, as air with a high temperature and a high humidity. However, some part of air flowing into the blower 5 is sufficiently dehumidified by passing through another portion of the heat exchanger 15, resulting in air with a low temperature and a low humidity. As a result, in the space from the blower 5 to the blowoff port 6, the air with a high temperature and a high humidity is cooled down by the air with a low temperature and a low humidity, and condenses, so that water drops scatters from the blowoff port 6 together with blowoff air.

As countermeasure against this, the length of the heat exchanger tubes arranged from the spot, at which the refrigerant flows into the leeward-side raw, up to the refrigerant outlet in each of the upper-side refrigerant channel and lower-side refrigerant channel may be made larger to some extent, thereby allowing the refrigerant to enter an overheated state only in leeward-side row heat exchanger tubes. Thereby, the refrigerant flowing through at least the windward-side row heat exchanger tubes enters a two-phase state or saturation state, so that it becomes air with a low temperature and a low humidity when passing the windward-side row heat exchanger tubes. This makes it possible to prevent air with a high temperature and a high humidity from flowing into the blower 5 and inhibit water drops from scattering from the blowoff port 6.

Herein, for example, in the upper-side refrigerant channel, the number of heat exchanger tubes from an oblique U-bend portion connecting the windward-side row D11 and the leeward-side row D21 up to the refrigerant outlet of the leeward-side row D26 is assumed to be six, that is, one fourth of the total heat exchanger tubes. Likewise, in the lower-side refrigerant channel, the number of heat exchanger tubes from an oblique U-bend portion connecting the windward-side row D112 and the leeward-side row D212 up to the refrigerant outlet of the leeward-side row D27 is assumed to be six. When driving a refrigeration cycle, there is very little possibility that one fourth of the total heat exchanger tubes enter overheated states, but here, in the upper-side refrigerant channel, six heat exchanger tubes in the vicinity of the refrigerant outlet, i.e., a half of the total heat exchanger tubes were arranged in the leeward-side row. On the other hand, in the lower-side refrigerant channel, six heat exchanger tubes in the vicinity of the refrigerant outlet, i.e., three-eighth of the total heat exchanger tubes were arranged in the leeward-side row. In each of the refrigerant channels, even if, the refrigerant corresponding to six heat exchanger tubes in the leeward-side row enters an overheated state, the refrigerant in a two-phase state flows in the windward-side row without fail, thereby allowing both of the windward-side row heat exchanger tubes and leeward-side row heat exchanger tubes to be prevented from entering an overheated state. Therefore, even if the refrigerant enters in an overheated state at the refrigerant outlet, and there occurs a "drying" phenomenon in which refrigerant temperature gets close to air temperature, wet air is dehumidified by the refrigerant in the windward-side row heat exchanger tube, so that it is possible to prevent an occurrence of condensation, which is caused by air with a high temperature and a high humidity and air with a low temperature and a low humidity being mixed after they have flowed out from the heat exchanger 15.

As described above, by constructing each refrigerant channel in the heat exchanger so that the refrigerant flowing through at least one heat exchanger tube out of heat exchanger tubes, which are arranged in mutually different rows and located in the vicinity of a passage of air flow, enters a two-phase refrigerant state, i.e., a saturated refrigerant state, it is possible to achieve an air conditioner capable of preventing an occurrence of condensation in the wind course in an indoor unit, and preventing water drops from scattering from the blowoff portion.

In particular, by providing the windward-side row refrigerant port 18 disposed in a heat exchanger tube 2 at a central portion of the most windward-side row, and the leeward-side row refrigerant ports 19*a* and 19*b* disposed in heat exchanger tubes 2 at a central portion of the most leeward-side row, and by connecting the heat exchanger tubes D21 and D212 located at the longitudinal ends of the most leeward-side row to the heat exchanger tubes D11 and D112 located in the most leeward-side adjacent row by the U-bends 4*b*, an air conditioner capable of preventing scattering of water drops can be achieved.

Instead of making long the length of heat exchanger tubes arranged between the inflow portion from the windward-side row heat exchanger tube to leeward-side row heat exchanger tube and the refrigerant outlet, the refrigerant channel may be configured so that heat exchanger tubes having the possibility that refrigerant therein in the vicinity of the outlet enter an overheated state, do not overlap each other between the windward-side row and leeward-side row with respect to airflow. Specifically, the refrigerant channel may be constructed by connecting heat exchanger tubes so that the refrigerant flowing through at least one-side heat exchanger tubes out of the windward-side row heat exchanger tubes, where air flowing into various portions of the heat exchanger 15 makes heat exchange in the windward-side row, and the leeward-side row heat exchanger tubes, where the air makes heat exchange in the leeward-side row, enter an two-phase state or saturation state. For example, when the refrigerant-enters an overheated state both in the windward-side row and leeward-side row, the refrigerant may be allowed to flow by interchanging the order of the flow of the refrigerant in the heat exchanger tubes in either one of the rows with that in other heat exchanger tubes in the same row.

Particularly in portions where the speed of air flow is large, since the refrigerant is apt to evaporate, it is desirable to prevent the refrigerant from entering an overheated state both in the windward-side row heat exchanger tubes and the leeward-side row heat exchanger tubes. Hence, in the upper heat exchanger 15*a* where the air speed is high, it is recommendable that the length of the heat exchanger tubes 2 from the spot from which the refrigerant flows into the most leeward-side row, up to the refrigerant outlet 19*a* is made long to some extent.

When the heat exchanger 15 is vertically arranged as shown in FIG. 6, the refrigerant flowing through the U-turn portions of hairpins 3, U-bends 4, and three-way bend 16, which are vertically arranged, are each subjected to gravity. Specifically, when a two-phase refrigerant having flowed-in from the refrigerant inlet flows through a one-path portion, and after having flowed through the short piping 16*b*, the refrigerant is distributed at a branch portion into the connection pipings 16*a* and 16*c*, the liquid refrigerant is apt to flow into the lower heat exchanger 15*b*, which is disposed on the lower side in the gravity direction, rather than into the upper heat exchanger 15*a*. In this embodiment, in the three-way bend 16 serving as a branch piping, by arranging a short piping 16*a* on the upper side in the gravity direction and a long piping 16*c* on the lower side in the gravity direction, a difference was made in pressure losses between two connection pipings 16*a* and 16*c*, which branch from one-path into two-paths. That is, by making the connection piping 16*c* on the lower side in the gravity direction, of the three-way bend 16, longer than the other connection piping 16*a*, pressure loss in the piping is increased, and the flow of refrigerant toward the connection piping 16*c* is made difficult. This allows the two-phase refrigerant to flow in an equally distributed state, and heat exchange performance to be improved.

Here, as in the case where one path is branched into a plurality of paths, in the case where the three-way bend 16 has three or more connection pipings, it is only necessary, when the number of paths is increased, that the branch pipe is configured so that the pressure loss of the refrigerant flowing through the connection piping connected to heat exchanger tubes on the lower side in the gravity direction, out of the connection pipings connected to heat exchanger tubes located on the downstream side of a refrigerant flow, is larger than the pressure loss of the refrigerant flowing through the connection piping connected to heat exchanger tubes on the upper side in the gravity direction.

Instead of making the length of the connection piping 16*c* longer than that of the connection piping 16*a*, the pressure loss of the connection piping 16*c* on the lower side in the gravity direction, out of the connection pipings 16*a* and 16*c*, may be made larger than the pressure loss of the other connection piping 16*a* by the use of another construction. For example, even by forming a groove or a small protrusion on the inner wall of the connection piping 16*c*, the pressure loss can be made larger. By making a difference in pressure loss so that the refrigerant is made difficult to flow through the piping disposed on the lower side in the gravity direction, it is possible to allow the two-phase refrigerant to branch into substantially equal parts at the branch portion.

In this manner, the branch pipe 16 has connection pipings 16*a*, 16*b*, and 16*c* for connecting with the connection portions to be connected to three or more heat exchanger tubes from the branch portion 20, and when the number of paths is increased, the branch pipe 16 was configured so that the pressure loss of the refrigerant flowing through the connection piping 16*c* connected to heat exchanger tubes on the lower side in the gravity direction, out of the connection pipings 16*a* and 16*c* connected to heat exchanger tubes located on the downstream side of a refrigerant flow, is larger than the pressure loss of the refrigerant flowing through the connection piping 16*a* connected to heat exchanger tubes on the upper side in the gravity direction. Thereby, an equal distribution of the two-phase refrigerant is realized and heat exchange performance is enhanced, thereby allowing achievement of an air conditioner with high energy efficiency.

In particular, the length from the branch portion 20 of the branch pipe 16 to the connection portion connecting with the heat exchanger tube 2 on the lower side in the gravity direction, that is, the length of the connection piping 16*c* was made larger than the length from the branch portion 20 of the branch pipe 16 to the connection portion connecting with the heat exchanger tube 2 on the upper side in the gravity direction, that is, the length of the connection piping 16*a*. Thereby, it is possible to make a difference in pressure loss between two connection pipings and easily implement an equal distribution of the two-phase refrigerant.

In the forgoing descriptions, the construction in which one path is branched into two paths has been explained, but this is not restrictive. Constructions in which one path is branched into a plurality of (three or more) paths may also be used. Also, the present invention is applicable to constructions in which a plurality of (two or more) paths branch into a plurality of (three or more) paths.

Furthermore, in the foregoing descriptions, the arrangement were used that has two rows of heat exchanger tubes, i.e., windward-side row heat exchanger tubes and leeward-side row heat exchanger tubes along the air flow direction, but arrangements having three rows or more of heat exchanger tubes may also be employed. In this case, the arrangement has only to be configured so that the refrigerant passing through each of the plurality of refrigerant channels between the refrigerant inlet and refrigerant outlet flows along one direction from the windward-side row to the leeward-side row in sequence between rows, e.g., in the case of three rows, in the order of the windward-side row→intermediate row→leeward-side row.

When an arrangement having three or more rows of heat exchanger tubes is to be provided, configuring refrigerant channels so that a refrigerant flowing through at least one heat exchanger tube out of heat exchanger tubes in mutually different rows located in the vicinity of a passage of air flow enters a two-phase refrigerant state or a saturated refrigerant state, makes it possible to prevent air flow at high temperature and high humidity from flowing into the blower 5, and inhibit water drops from scattering from the blowoff port 6.

Also, when a plurality of refrigerant channels is to be formed, making equal the length of each of the channels equal desirably allows heat exchange to be performed in a balanced manner. Here, the upper-side refrigerant channel is equivalent in length to twelve heat exchanger tubes, and the lower-side refrigerant channel is equivalent in length to sixteen heat exchanger tubes. Although they are not equal in length, they can be regarded as being substantially equal in length.

Next, a description will be made of the case where the air conditioner is operated in a heating operation mode and the heat exchanger 15 is operated as a condenser. The construction of an indoor unit is similar to that in the case where the heat exchanger 15 is operated as an evaporator, as shown in FIG. 3. However, the positional relationship of the inlet and outlet of the refrigerant flowing through the heat exchanger 15 becomes opposite to that in the evaporator case, and the flowing direction of the refrigerant also becomes opposite to that in the evaporator case.

Figure 10:
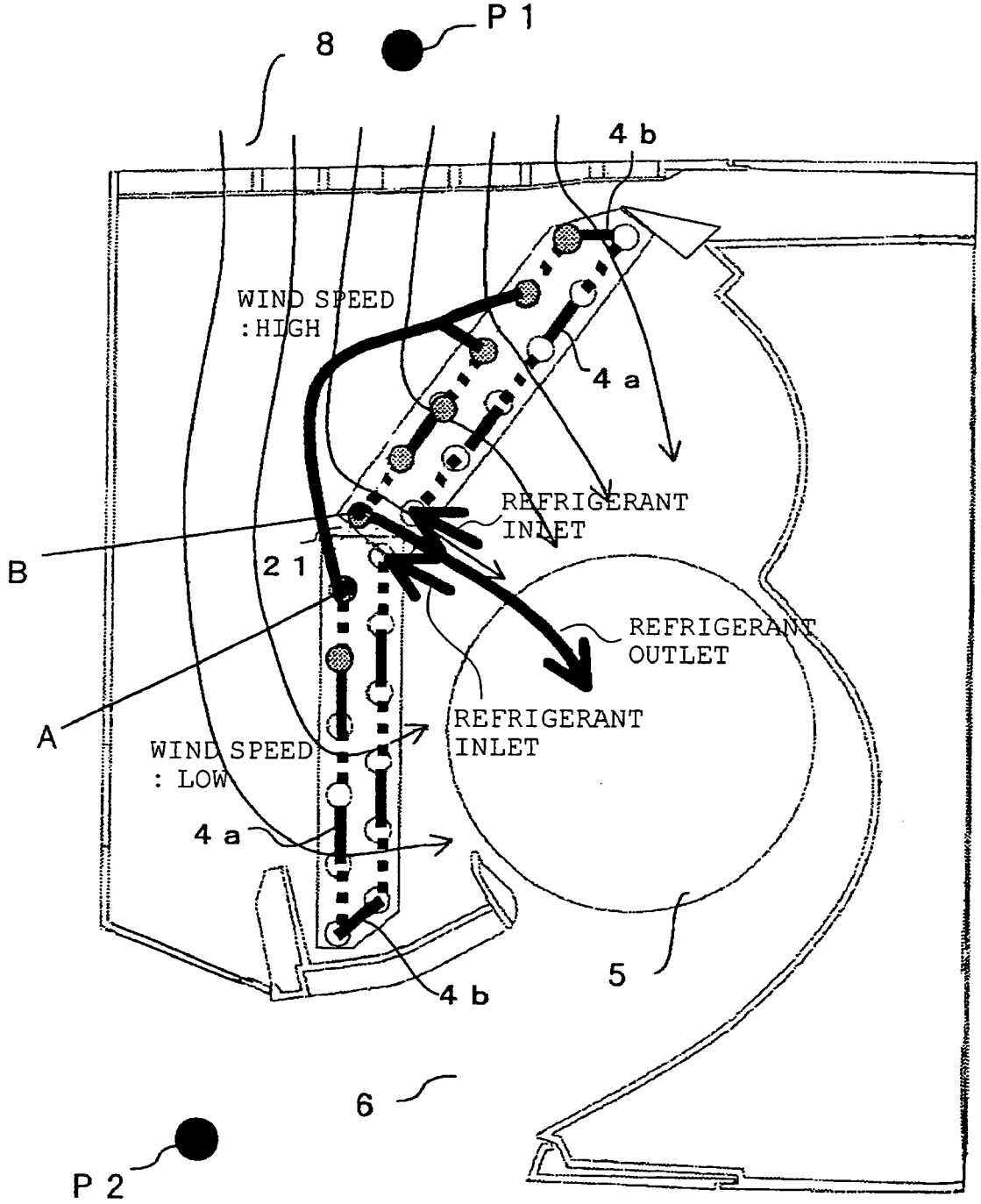
FIG. 10 is an explanatory view showing refrigerant flows and airflows at the time when the heat exchanger according to the first embodiment of the present invention is used as a condenser.
Figure 11:
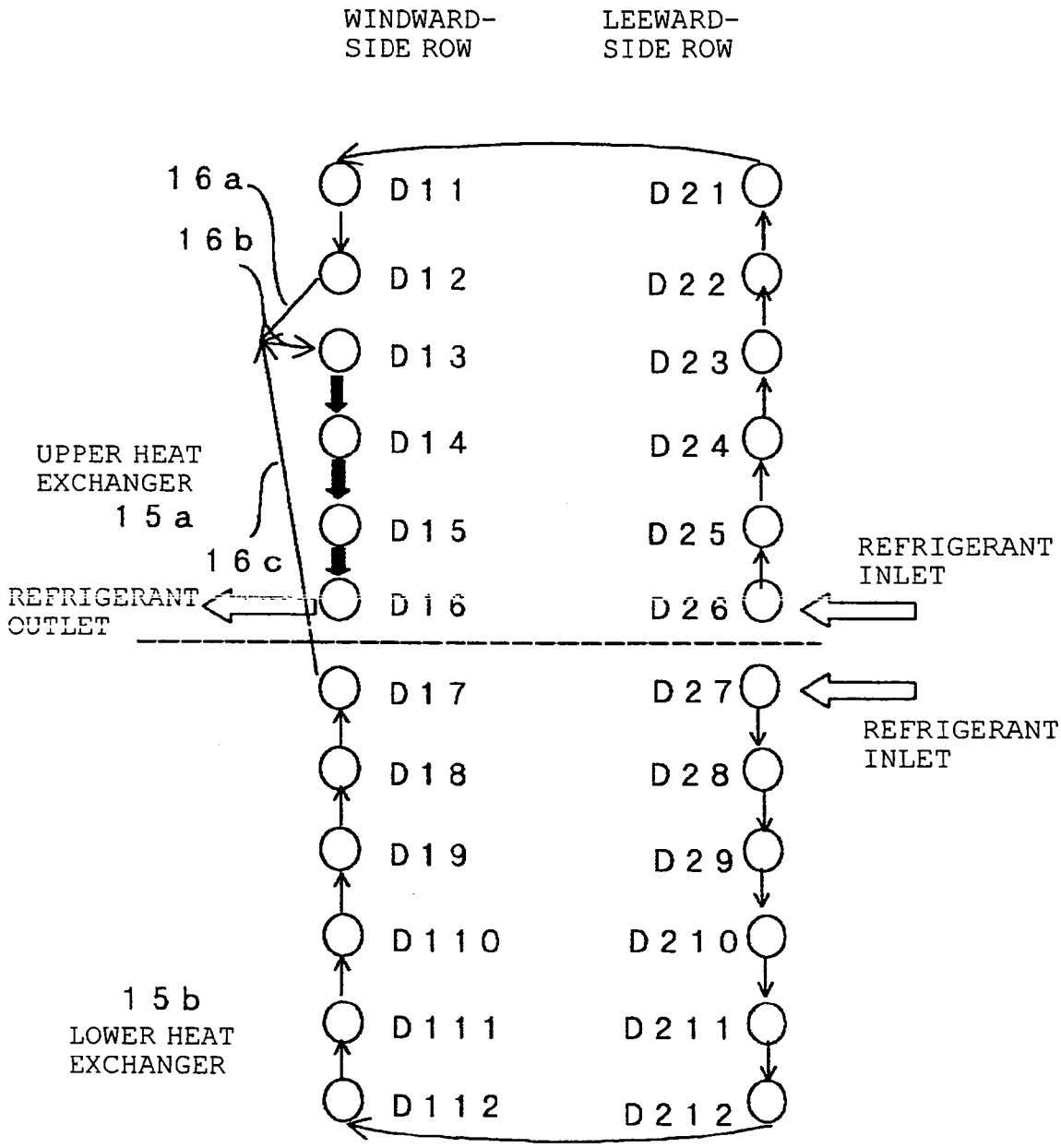
FIG. 11 is an explanatory view schematically showing a connection state of heat exchanger tubes according to the first embodiment of the present invention.

FIG. 10 is an explanatory view showing refrigerant flows and airflows at the time when the heat exchanger according to this embodiment is used as a condenser. Here, the heat exchanger tubes indicated by dark circles are a portion where a refrigerant flowing inside the heat exchanger has a possibility of entering supercooled state, and this portion herein is assumed to be equivalent in length to several, e.g., six heat exchangers from the refrigerant outlet side. FIG. 11 is an explanatory view schematically showing a connection state of exchanger tubes. When the heat exchanger 15 is operated as a condenser, most leeward-side row ports 19*a* and 19*b* are assumed to be refrigerant inlets, and a most windward-side row port 18 is assumed to be a refrigerant outlet.

Under the rotation of blower 5, air having flowed-in from the intake port 8 flows between the fins 1 of the heat exchanger 15, and after having made heat exchange with the refrigerant flowing through the heat exchanger tubes 2, flows out from the blowoff port 6. As in the case where the heat exchanger 15 is operated as an evaporator, the air flow is high in wind speed in the upper portion of the heat exchanger 15, and low in wind speed in the lower portion thereof. On the other hand, the direction of the refrigerant flow is opposite to that in the case where the heat exchanger 15 is operated as an evaporator. Specifically, the refrigerant inlets are a sixth heat exchanger tube D26 in the leeward-side row and a seventh heat exchanger tube D27 in the leeward-side row, each serving as the most leeward-side row port, while the refrigerant outlet is a sixth heat exchanger tube D16 in the windward-side row, serving as the most windward-side row port.

Figure 12:
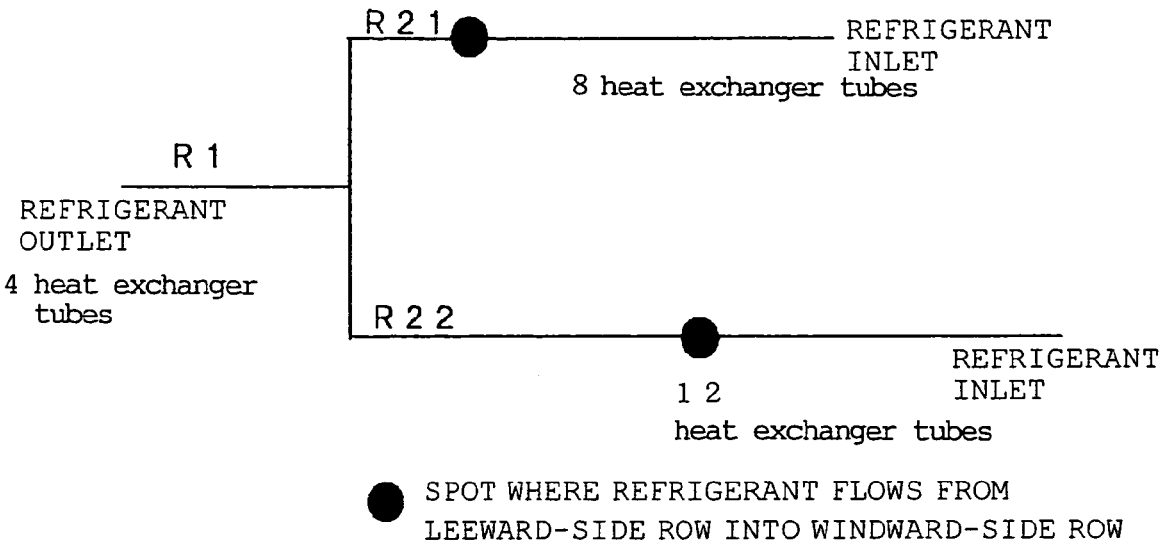
FIG. 12 is an explanatory view showing the construction of refrigerant paths according to the first embodiment of the present invention.

FIG. 12 is an explanatory view showing the construction of refrigerant paths. For example, in the construction according to this embodiment, the refrigerant inlet is connected to two-path portions R21 and R22. Here, the R21 is equivalent in length to eight heat exchanger tubes, and the R22 is equivalent in lengthy to twelve heat exchanger tubes. The flows of refrigerant join with each other at the one-path portion R1, and flows through the one-path portion R1 equivalent in length to four heat exchanger tubes. The R1 is connected to the refrigerant outlet. Black circles in the two-path portions R21 and R22 each indicate a portion connected from a heat exchanger tube in the leeward-side row to a heat exchanger tube in the windward-side row.

When the heat exchanger is operated as a condenser, the refrigerant flows into the refrigerant inlet of the heat exchanger 15 in an overheated vapor state, that is, as a vapor at a temperature higher than a refrigerant saturation temperature. This overheating area is short, and has a relatively little influence on heat exchanger performance. Thereafter, upon arrival at the saturation temperature under cooling, the refrigerant enters a saturated state, for example, a two-phase state. The refrigerant in the two-phase state has a very large heat transfer coefficient, and is responsible for most of the heat exchange amount. When the degree of dryness (=vapor mass speed/liquid mass speed) of the refrigerant becomes zero or less, the refrigerant enters a single-phase liquid state, which is referred to as a supercooled state. With supercooling provided, the heat transfer coefficient significantly decreases in comparison with a two-phase area, and the capacity of the heat exchanger degrades. As a result, pressure on the blowoff side of a compressor increases, and thereby the compressor input increases. This constitutes a factor responsible for deterioration of heating energy efficiency. On the other hand, with supercooling provided, difference in enthalpy between the inlet and outlet of the heat exchanger increases, and thereby the heat exchange amount increases. As a consequence, a frequency of compressor can be reduced and the compressor input can be reduced, thereby producing the effect of improving heating energy efficiency. In the air conditioner, these degrading factor and improving factor with respect to energy efficiency are taken together into consideration, and thereby the best degree of supercooling (=saturation temperature–heat exchanger outlet temperature) is determined for operation.

As described above, since the supercooled portion in the vicinity of the refrigerant outlet is low in heat transfer coefficient and responsible for the reduction in heat exchange performance, the portion through which supercooled refrigerant flows is made the one-path portion R1 for increasing a flow speed. When comparing the one-path portion R1 and the two-path portions R21 and R22 in the refrigerant channel, since the two-path portions R21 and R22 are low in pressure loss than the one-path portion R1, pressure loss is somewhat increased by making the above-described portion constituted by one-path portion. However, because the refrigerant in this portion is in a supercooled state, the pressure loss increased here is lower than the portion of the two-phase refrigerant having higher gas percentage. Here, by making this portion one-path portion, a heat transfer coefficient is increased, and thereby a heat exchange performance improving effect can be obtained. Specifically, in the portion where the refrigerant flow in a saturated state or overheated state, pressure loss is reduced and burden upon the compressor 10 is decreased by forming the refrigerant channel by the two-path portions R11 and R22. On the other hand, in the portion where the refrigerant flows in a supercooled state, in the vicinity of the refrigerant outlet, heat exchange performance is improved by forming the refrigerant channel by the one-path portion R1.

Figure 13:
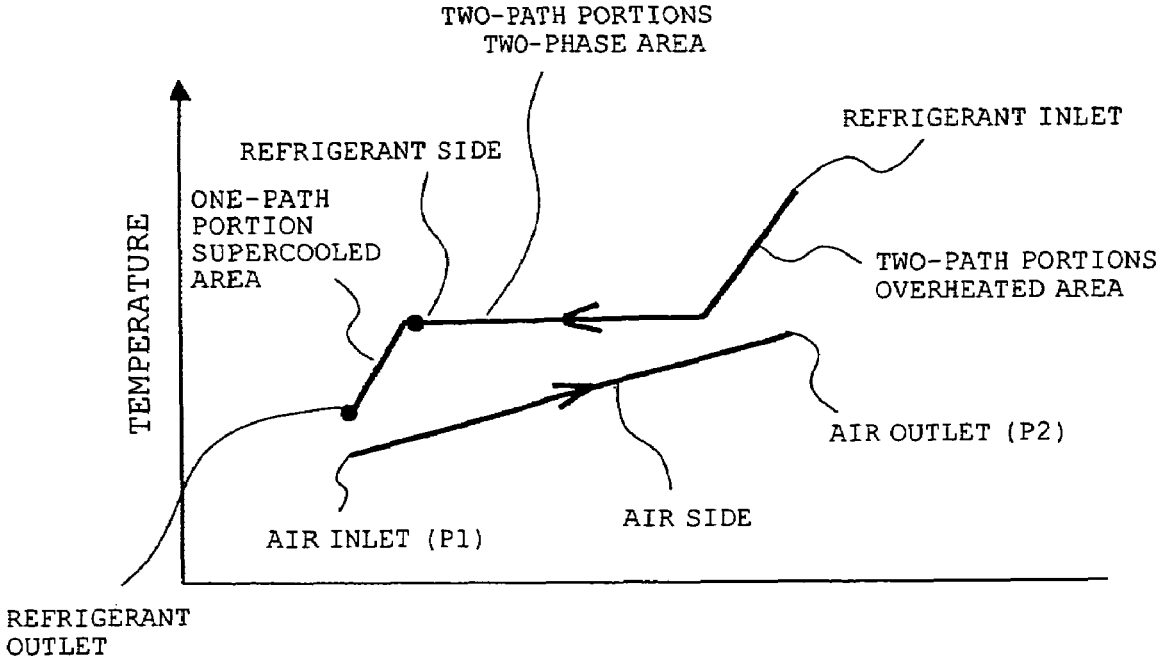
FIG. 13 is a graph showing changes in refrigerant temperatures along the refrigerant flow direction, and changes in air temperature along the airflow direction, according to the first embodiment of the present invention.

FIG. 13 is a graph showing changes in refrigerant temperature along the direction of a refrigerant flow, and in air temperature along the direction of airflow, in the heat exchanger 15 constructed as shown in FIGS. 10 to 12. Here, the abscissa denotes a position of air or the refrigerant in a flow direction thereof, and the ordinate denotes temperature. Regarding the refrigerant side, the temperature of the refrigerant flowing into the heat exchanger tubes D26 and D27 is assumed to be a refrigerant inlet temperature, and the temperature of the refrigerant flowing out from the heat exchanger tube D16 is assumed to be a refrigerant outlet temperature. Over the course of time, the refrigerant gradually condenses, and enters from an overheated state into a supercooled state via two-phase region. Here, the refrigerant temperature decreases in the overheated area and supercooled area, and the refrigerant is subjected to a phase change at a substantially constant temperature in the two-phase region. On the other hand, regarding air side, letting the vicinity of a black circle P1 in FIG. 10 be an air inlet, and letting the vicinity of a black circle P2 in FIG. 10 be an air outlet, the refrigerant is heated up by the heat exchanger 15 while it is flowing from the inlet P1 to the outlet P2, and thus the air temperature increases from the inlet P1 toward the outlet P2.

The details of a flow of refrigerant will be discussed in more depth below.

As shown in FIG. 11, the refrigerant having flowed-in from the lowest heat exchanger tube D26 in the leeward-side row in the upper heat exchanger 15*a* passes through a two-path portion D26 to D21 in the upper heat exchanger 15*a*, and flows into the windward-side row when flowing from a heat exchanger tube D21 to a heat exchanger tube D11. Furthermore, the refrigerant flows to a heat exchanger tube D12, and after having flowed into a three-way bend 16, the refrigerant flows to join with each other and flow into a one-path portion. The shorter connection piping 16*a* is connected to the heat exchanger tube D12 in the upper heat exchanger 15*a*. The refrigerant passes through the connection piping 16*a* and 16*b*, and flows to the refrigerant outlet through D13 to D16. Specifically, as shown in FIG. 12, the refrigerant passes through the two-path portion R21 and the one-path portion R1 between the refrigerant inlet and the refrigerant outlet, that is, the refrigerant flows through the heat exchanger tubes 2 equivalent in length to twelve heat exchanger tubes. Here, the channel between the refrigerant inlet and the refrigerant outlet is referred to as an upper-side refrigerant channel.

On the other hand, the refrigerant that has flowed-in from the uppermost heat exchanger tube D27 in the leeward-side row in the lower heat exchanger 15*b* passes through the two-path portions D27 to D212 in the lower heat exchanger 15*b*, and flows into the windward-side row when flowing from the heat exchanger tube D212 to the heat exchanger tube 112. Furthermore, the refrigerant flows into the heat exchanger tube D17 and after having flowed into a three-way bend 16, the refrigerant flows to join with each other and flow into the one-path portion. The longer connection piping 16*c* is connected to the heat exchanger tube D17 in the lower heat exchanger 15*b*. The refrigerant passes through the connection piping 16*c* and 16*b*, and flows to the refrigerant outlet through the D13 to D16. That is, as shown in FIG. 12, the refrigerant passes through the two-path portion R22 and the one-path portion R1 between the refrigerant inlet and the refrigerant outlet, i.e., it flows through heat exchanger tubes 2 equivalent in length to sixteen heat exchanger tubes 2. Here, the channel between the refrigerant inlet and the refrigerant outlet is referred to as a lower-side refrigerant channel.

In the upper-side refrigerant channel and lower-side refrigerant channel, the refrigerant that has flowed-in from respective refrigerant inlets 19*a* and 19*b* flows through the hairpins 3 and U-bends 4*a* in the leeward-side row, the hairpins 3 and the U-bends 4*a* being each arranged perpendicularly to the airflow direction. Also, the refrigerant flows through a U-bends 4*b* in a direction substantially opposite to the airflow direction, the U-bend 4*b* being arranged in parallel to the airflow direction. After having flowed through the hairpins 3 and the U-bends 4*a* in the windward-side row, the refrigerant passes through the three-way bend, and flows out from the refrigerant outlet 18. Thus, the refrigerant channel is constructed by connecting heat exchanger tubes so that the refrigerant never flows in parallel to the airflow direction in the overall refrigerant channel.

In the heat exchanger as shown in FIG. 10, the refrigerant flows along one direction from the windward-side row to the leeward-side row in sequence, in each of the upper-side refrigerant channel and the lower-side refrigerant channel. Consequently, as shown in FIG. 13, the refrigerant temperature monotonously decreases from the refrigerant inlet toward the refrigerant outlet, and this change in refrigerant temperature is in substantially parallel to the change in air temperature. As a result, the difference between the air temperature and the refrigerant temperature is always kept constant, and the heat exchange between refrigerant and air is efficiently performed at any portion of the heat exchanger 15, thereby allowing an improvement in heat exchange capability and an achievement of an air conditioner with high energy efficiency.

As shown in FIG. 12, if the arrangement is such that a spot (indicated by a black circle) where the refrigerant flows from the second leeward-side row into the first windward-side row exists at only a single location for each of all refrigerant channels, the refrigerant to flow through each of the upper-side refrigerant channel and the lower-side refrigerant channel flows along one direction from the leeward-side heat exchanger tubes to the windward-side heat exchanger tubes in sequence. As a result, the temperature on the refrigerant side monotonously decreases from the refrigerant inlet toward the refrigerant outlet, and the changes in refrigerant temperature become substantially parallel to the changes in air temperature.

When the refrigerant channel is configured so that the refrigerant moves back and forth a plurality of times between the windward-side row heat exchanger tubes and the leeward-side row heat exchanger tubes, there is a possibility that the supercooled area enters the leeward-side row heat exchanger tubes, and that both of the refrigerant portions flowing through the windward-side row heat exchanger tubes and the leeward-side row heat exchanger tubes, which are located in the vicinity of a passage of air flow may enter a supercooled state. At this time, air passes through only the supercooled area and blows off, thereby reducing heat exchange capability. Even if this is not the case, an occurrence of a place where temperature difference between air and the refrigerant is large, reduces the heat exchanger capability. Here, since the refrigerant flows along one direction from the leeward-side row to the windward-side row in sequence, it is prevented that the refrigerant flows in parallel to the air flow direction. As a result, it is possible to cause changes in air temperature and in refrigerant temperature to be substantially parallel to each other to thereby uniformalize the temperature difference therebetween, resulting in an enhanced heat exchange capability.

As described above, the present air conditioner has a branch pipe 16 connected to heat exchanger tubes 2 and partially increasing or decreasing the path number in the refrigerant channels by the heat exchanger tubes 2, and is configured so that the refrigerant flowing through each of the plurality of refrigerant channels, which are so formed as to allow the refrigerant to pass through paths mutually different at least one portion between the refrigerant inlets 19*a* and 19*b* and the refrigerant outlet 18, flows along one direction from the leeward-side row to the windward-side row in the airflow direction in sequence between rows. Thereby, heat transfer performance is improved by an efficient heat exchange being performed at any portion of the heat exchanger, and thus an air conditioner with high energy efficiency can be achieved.

The construction of the refrigerant channels shown here is only an example, and not restrictive. In the heat exchanger 15 used as a condenser, any two of the leeward-side row heat exchanger tubes are employed as refrigerant inlets, and any one of the windward-side row heat exchanger tubes are employed as a refrigerant outlet. The one-path portion R1 is assumed to be only a windward-side row heat exchanger tube portion without extending over a plurality of rows. In all of the plurality of refrigerant channels constructed, the refrigerant has only to flow along one direction from the leeward-side row to the windward-side row in sequence without flowing back in the opposite direction (windward-side row→leeward-side row) between rows. Thereby, the changes in air temperature and in refrigerant temperature can be made substantially parallel to each other, and a heat exchange can be efficiently performed at any portion in the heat exchanger 15, resulting in an enhanced heat transfer performance.

In the heat exchanger according to this embodiment, the one-path portion is disposed at a portion where wind speed is high, in the vicinity of the lowermost portion in the windward-side row in the upper heat exchanger 15*a*. As a consequence, the degree of supercooling of refrigerant can be made higher, thereby allowing heat exchange amount to be increased. In particular, since the supercooling degree of refrigerant is made higher by making use of a portion where wind speed is high, a few number of heat exchanger tubes allows a higher degree of supercooling, thereby improving heat exchange capability.

In this manner, by arranging the branch pipe 16 to be able to increase or decrease the number of paths with the one-path portion and plural-path portions and by disposing the one-path portion R1 in the most windward-side row in the air flow direction, the degree of supercooling of refrigerant can be made higher to thereby increase heat exchange amount.

FIG. 13 is a graph showing refrigerant temperatures at the inlet A of the one-path portion and the refrigerant outlet B in FIG. 10. In FIG. 13, these refrigerant temperatures are shown at points A and B in a supercooled region in the temperature change. Because the refrigerant outlet B provided at the lowermost portion of the upper heat exchanger 15*a* and the connection portion A with the three-way bend 16 in the lower heat exchanger 15*b* are in a supercooled area, the temperature difference therebetween is much larger than in two-phase area. Then, in this embodiment, an arrangement is used in which the heat exchanger is constituted of an upper heat exchanger 15*a* and a lower heat exchanger 15*b* with fins separately provided. Specifically, the connection of the three-way bend 16 is performed so as to cover two upper heat exchangers 15*a* and 15*b*, and a heat exchanger tube D16 at the refrigerant outlet B is disposed in lower heat exchanger 15*b*. As a result, the fins, to which there are provided heat exchanger tubes having a large temperature difference between A and B, are thermally separated with intervention of a space 21 between the upper heat exchanger 15*a* and lower heat exchanger 15*b* thereby eliminating heat conduction therebetween. This prevents a thermal loss, resulting in an improved heat exchange capability.

In this way, by arranging the refrigerant channel so as to be changeable from a plurality of paths into one path to reduce the number of paths during operation of the heat exchanger as a condenser, and by thermally separating fins in close contact with a heat exchanger tube in the vicinity of the refrigerant outlet and fins in close contact with a heat exchanger tube located nearest the refrigerant outlet out of heat exchanger tubes located at the most downstream position of each of the plural paths, it is possible to enhance heat exchange capability.

The portions where a temperature difference is large in the supercooled area, was thermally separated by separately forming the heat exchanger into the upper heat exchanger 15*a* and lower heat exchanger 15*b*, but this is not restrictive. For example, as thermal separation means 21, integrally forming the upper heat exchanger 15*a* and lower heat exchanger 15*b*, and providing grooves or thermal shields for fins between the supercooled inlet A and the refrigerant outlet B allows the above-described portions to be thermally separated from each other, as well. This enables thermal loss to be reduced, and heat exchange capability to be improved.

If the supercooled area and other areas, particularly, the outlet portion of the supercooled area and two-phase area/overheated area, are thermally separated from each other, it would be better in that a thermal loss in fins between heat exchanger tubes with a large temperature difference can be prevented to thereby enhance heat exchange capability. Therefore, providing isolation slits for fins 1 between the windward-side row heat exchanger tubes and leeward-side row heat exchanger tubes, i.e., in the longitudinal direction of fins 1 between heat exchanger tube rows, allows heat exchanger tube rows to be thermally separated, which leads to an improvement in heat exchange performance.

By integrally forming the heat exchanger 15, fins that are easy to manufacture and easily treated in the manufacturing process can be obtained, as compared with the case where the heat exchanger is separated into the upper heat exchanger 15*a* and lower heat exchanger 15*b*.

In this manner, the refrigerant channel is so arranged as to be decreased from plural-path portions R21 and R22 into one-path portion R1 when the heat exchanger 15 is operated as a condenser, and by thermally separating fins 1 in close contact with a heat exchanger tube 2 at the refrigerant outlet 18 and fins in close contact with a heat exchanger tube 2 (D17) located nearest the refrigerant outlet 18 out of heat exchanger tubes 2 (D12 and D17) located at the most downstream position of each of the plural-path portions R21 and R22, it is possible to prevent thermal loss in fins between the heat exchanger tubes 2 having a large temperature difference therebetween (here, heat exchanger tubes 16 and 17), and thereby to enhance heat exchange capability.

The heat exchanger 15 disposed on the front side of the blower 5 is composed of two heat exchangers 15*a* and 15*b* having substantially equal shapes arranged in a "chevron" shape. Thereby, an arrangement for thermal separation can be easily implemented, leading to an improvement in heat exchange capability.

Here, the heat exchanger 15 is constituted of an upper heat exchanger 15*a* and a lower heat exchanger 15*b* that are vertically separated; a refrigerant outlet 18 at the time when the heat exchanger 15 is used as a condenser is disposed in a heat exchanger tube 2 (D16) located at the lowermost portion in the gravity direction of the upper heat exchanger 15*a*; and out of connection pipings 16*a*, 16*b*, and 16*c* of the branch pipe 16, at least one of the connection pipings 16*a* and 16*c* (in this case, 16*c*) connected to the upstream side in the refrigerant flow is disposed to the lower heat exchanger 15*b*, whereby an arrangement for thermal separation is easily realized, and an enhancement of heat exchange capability can be achieved.

For example, regarding the refrigerant channels, between the refrigerant inlet 18 and the refrigerant outlets 19*a* and 19*b*, having a plurality refrigerant channels that are formed to pass through mutually different paths at least one portion, even if the refrigerant channels are not configured so that the refrigerant passing through each of the plural refrigerant channels flows along one direction from the windward-side row to the leeward-side row or from the leeward-side row to the windward-side row in the airflow direction in sequence between rows, but are configured so that, for example, in one portion of the refrigerant channels, the refrigerant flows in directions opposite to each other between rows, they would exert effect to some extent by configuring as follows.

By making a part of the most windward-side row heat exchanger tubes a one-path portion R1 to put the one-path portion in a portion where wind speed is high, it is possible to make high the degree of supercooling at the time when the heat exchanger 15 is operated as a condenser, thereby resulting in an increased heat exchange capability. Furthermore, as separation means 21 for thermally separating the fins 1 vertically in the longitudinal direction of the fins at least on the windward side of the fins 1, here, the heat exchanger 15 is separated into an upper heat exchanger 15*a* and lower heat exchanger 15*b*, and fins in close contact with the heat exchanger tubes connected to two connection pipings 16*a* and 16*c* are separated into upper heat exchanger 15*a* portion and lower heat exchanger 15*b* portion so that the fins 1 are thermally separated. Thereby, since the fins 1, which are in close contact with the heat exchanger tubes 2 having a large temperature difference as a supercooled portion at the time when the heat exchanger 15 operates as a condenser, are thermally separated, thermal loss in fins can be reduced, thereby providing an air conditioner capable of enhancing heat exchange capability.

Regarding the separation means, the fins 1 may be thermally separated vertically in the longitudinally direction of the fins by providing notches in the air flow direction for separating the fins 1 vertically at least in the windward portion of the fins 1, so as to produce an effect similar to the foregoing.

As described above, the present air conditioner includes a branch pipe 16 for branching, from one-path into two-path, the flow from the windward-side row refrigerant port 18 provided at a central portion of the most windward-side row up to the leeward-side row refrigerant ports 19*a* and 19*b* provided at a central portion of the most leeward-side row, and separation means 21 for thermally separating fins 1 vertically in the longitudinal direction at least on the most windward side; and is configured so that at least a part of the most windward-side row is constituted of one-path portion R1, and that, fins in close contact with the heat exchanger tube D17 located in the vicinity of windward-side row refrigerant port 18 out of two heat exchanger tubes D12 and D17 connected to the two-path portions R1 and R2 of the branch pipe 16, and fins in close contact with windward-side row refrigerant port 18 are thermally separated from each other. Thereby, it is possible to reduce thermal loss in the fins 1, and achieve an air conditioner capable of enhancing heat exchange capability.

Figure 14:
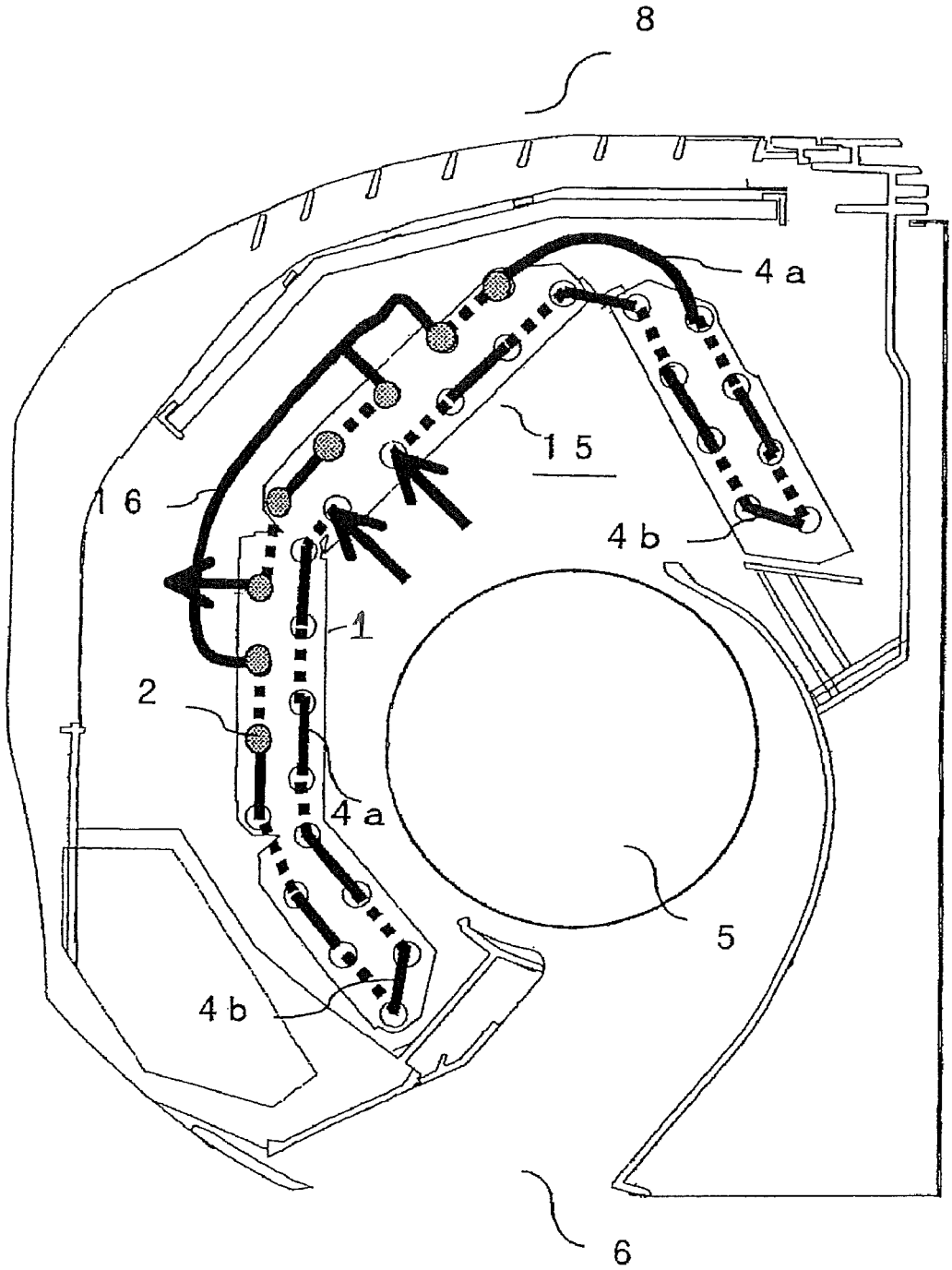
FIG. 14 is a constructional side view of another construction example according to the first embodiment of the present invention.
Figure 15:
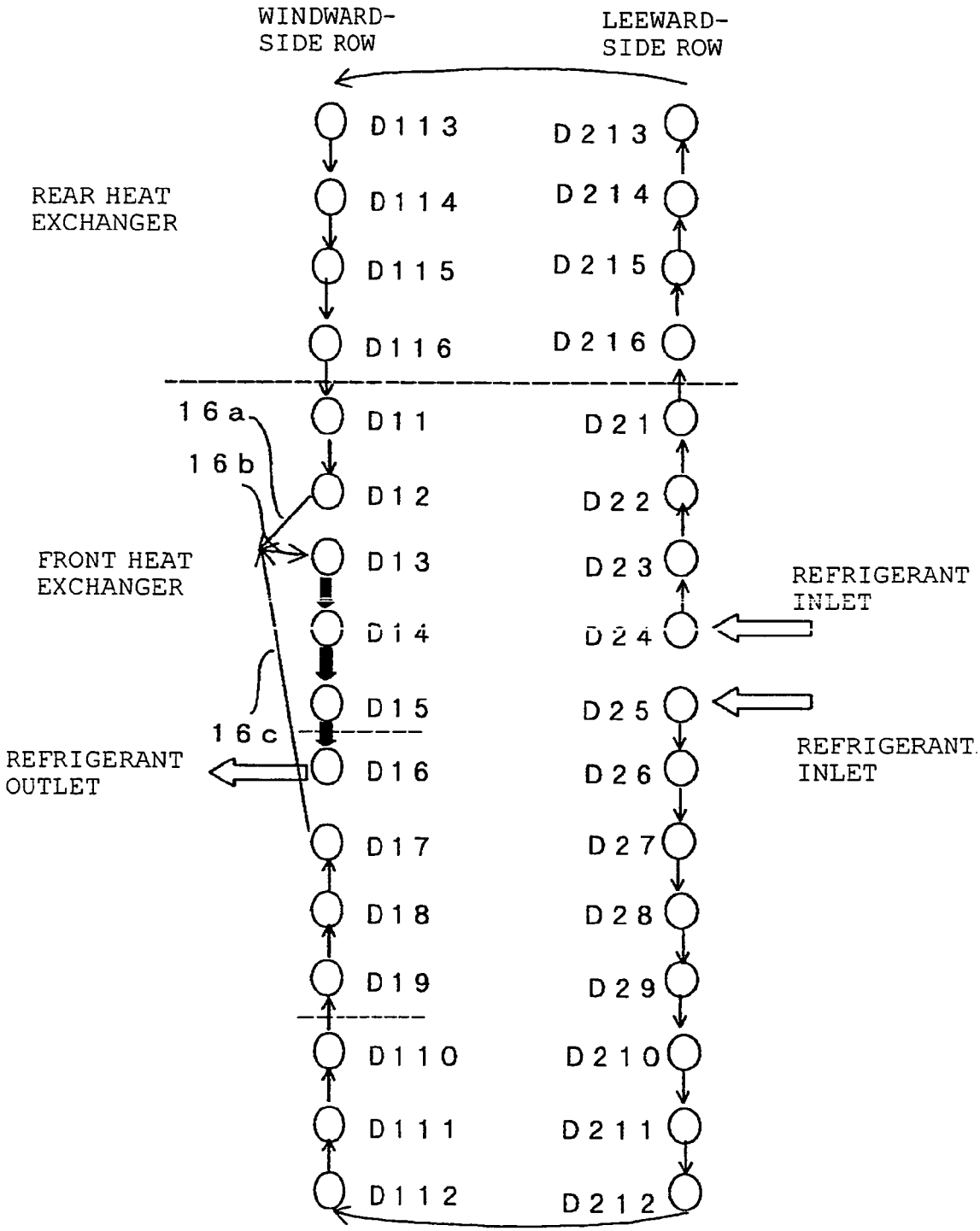
FIG. 15 is an explanatory view schematically showing a connection state of heat exchanger tubes according to the first embodiment of the present invention.

A construction example in which a heat exchanger 15 is additionally arranged on the rear surface side, is illustrated in FIG. 14. FIG. 14 is a constructional side view showing an indoor unit according to this embodiment. In FIG. 14, a rear heat exchanger is disposed on the rear surface side of the blower 5, and front heat exchangers and a rear heat exchanger that are divided into substantially three constitute a heat exchanger 15. The heat exchanger 15 are arranged on the intake port 8 side of the blower 5 so as to surround the blower 5. FIG. 15 is an explanatory view schematically showing the connection state of heat exchanger tubes when a rear heat exchanger is provided. Here, a case where the heat exchanger is operated as a condenser is shown as an example. Under the rotation of blower 5, air having flowed-in from the intake port 8 flows between the fins 1 of the heat exchanger 15 as is the case in FIG. 10, and after having made heat exchange with the refrigerant flowing through the heat exchanger tubes 2, flows out from the blowoff port 6. On the other hand, regarding the refrigerant flow, the refrigerant inlets are a fourth heat exchanger tube D24 in the leeward-side row and a fifth heat exchanger tube D25 in the leeward-side row, while the refrigerant outlet is a sixth heat exchanger tube D16 in the windward-side row.

Figure 16:
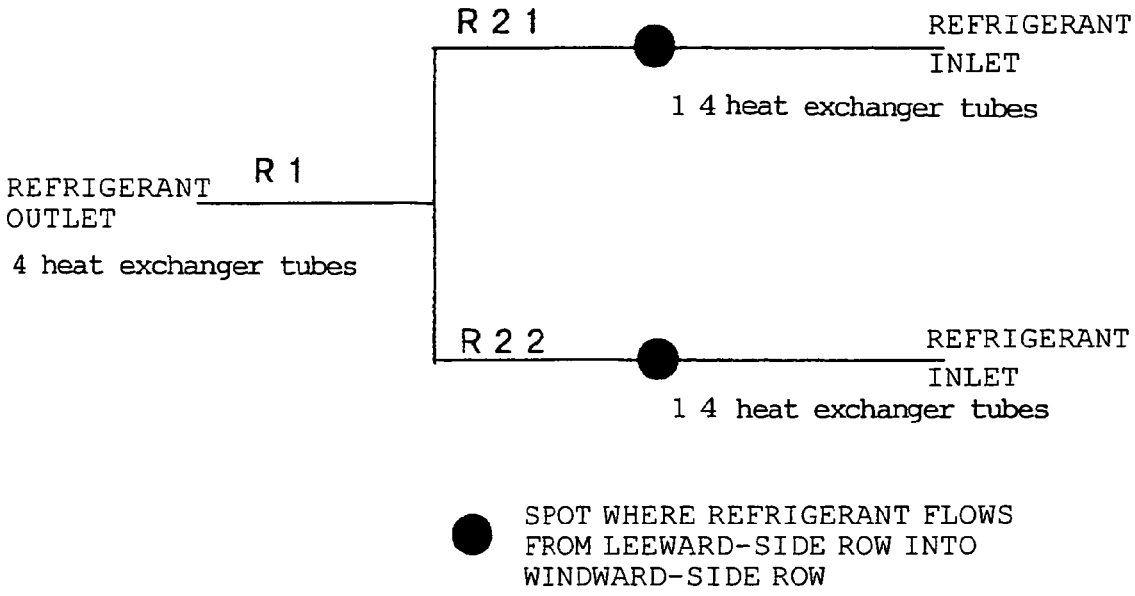
FIG. 16 is an explanatory view showing the construction of refrigerant paths, according to the first embodiment of the present invention.

FIG. 16 is an explanatory view showing the construction of refrigerant paths. For example, in this construction, the refrigerant inlets are connected to two-path portions R21 and R22. Here, the R21 is equivalent in length to fourteen heat exchanger tubes, and the R22 is equivalent in length to fourteen heat exchanger tubes. The flows of refrigerant join with each other at the one-path portion R1, to flow through the one-path portion R1 equivalent in length to four heat exchanger tubes. The R1 is connected to the refrigerant outlet. Black circles in the two-path portions R21 and R22 each indicate a portion connected from a heat exchanger tube in the leeward-side row to a heat exchanger tube in the windward-side row.

As shown in FIG. 15, in the upper-side refrigerant channel, the refrigerant passes through a heat exchanger tube D24 disposed at a central portion in the leeward-side row in the front heat exchanger and serving as the most leeward-side row refrigerant port, and two-path portions D24 to D21, and after having passed the leeward-side row heat exchanger tubes D216 to D213 in the rear heat exchanger, it flows into the windward-side row when flowing from a heat exchanger tube D213 to heat exchanger tube D113. Then, the refrigerant flows through heat exchanger tubes D113 to D116, and windward-side row heat exchanger tubes D11 and D12 in the front heat exchanger, and thereafter, flows to a refrigerant outlet, serving as the most windward-side row refrigerant port, through the short connection piping 16*a* and 16*b* of the three-way bend 16 and heat exchanger tubes D13 to D16. That is, as shown in FIG. 16, the refrigerant passes through the two-path portion R21 and the one-path portion R1 between the refrigerant inlet and the refrigerant outlet, i.e., it flows through the heat exchanger tubes 2 equivalent in length to eighteen heat exchanger tubes 2.

On the other hand, in the lower-side refrigerant channel, the refrigerant passes through a heat exchanger tube D25 disposed at a central portion in the leeward-side row in the front heat exchanger and serving as the most leeward-side row refrigerant port, and two-path portions D25 to D212, and flows into the windward-side row from D212. Then, the refrigerant flows through heat exchanger tubes D112 to D17, and passes through the long connection piping 16*c* of the three-way bend 16, the heat exchanger tube D17 in the front heat exchanger, connection piping 16*b*, and one-path portions D13 to D16 in the front heat exchanger, and thereafter flows to the refrigerant outlet disposed at a central portion in the windward-side row and serving as the most windward-side row refrigerant port. That is, as shown in FIG. 16, the refrigerant passes through the two-path portion R22 and the one-path portion R1 between the refrigerant inlet and the refrigerant outlet, i.e., it flows through the heat exchanger tubes 2 equivalent in length to eighteen heat exchanger tubes 2.

With this arrangement also, in the portion where the percentage of gas is higher, in the vicinity of the refrigerant inlet, refrigerant channels are formed by two-path portions R21 and R22, so that pressure loss is reduced, and burden on the compressor 10 is decreased, as well as heat exchange performance is improved by forming a supercooled area in the vicinity of the refrigerant outlet by the one-path portion R1.

The changes in refrigerant temperature and in air temperature by the heat exchanger 15 constructed as shown in FIGS. 14 to 16 are similar to those in FIG. 13.

As can be seen from FIG. 16, a spot (indicated by a black circle) where the refrigerant flows from the second leeward-side row into the first windward-side row exists at only a single location for each of all of the plurality of refrigerant channels. That is, the refrigerant flows through each of the upper-side refrigerant channel and the lower-side refrigerant channel along one direction from the leeward-side row to the windward-side row in sequence. As a result, as shown in FIG. 13, the temperature on the refrigerant side monotonously decreases from the refrigerant inlet toward the refrigerant outlet, and the change in refrigerant temperature become substantially parallel to the change in air temperature, thereby always keeping the difference between the air temperature and the refrigerant temperature constant. This allows the heat exchange between refrigerant and air to be efficiently performed, resulting in an improved heat exchange capability.

In this manner, even in the case where a rear heat exchanger is provided, arranging each of the plurality of refrigerant channels so as to flow from the leeward-side row to the windward-side row in sequence enables an enhancement of heat exchange performance.

In this case also, the present air conditioner has a branch pipe 16 connected to heat exchanger tubes 2 to partially increase or decrease the path number in refrigerant channels by the heat exchanger tubes 2, and is configured so that the refrigerant flowing through each of the plurality of refrigerant channels that are formed to pass through mutually different paths at least at one portion between the refrigerant inlets 19*a* and 19*b* and the refrigerant outlet 18, flows along one direction from the leeward-side row to the windward-side row in the airflow direction in sequence between rows. Thereby, heat transfer performance is improved by an efficient heat exchange being performed at any portion of the heat exchanger, and thus an air conditioner with high energy efficiency can be achieved.

In the arrangement shown in FIG. 14, the thermally separated portions of the fins 1 include a portion separated by the rear heat exchanger and front heat exchanger, i.e., a portion between the heat exchanger tubes D116 and D11, and a portion between the heat exchanger tubes D216 and D21; and portions where a notch is provided in the windward portion of the fins 1 in the front heat exchanger, i.e., a portion between the heat exchanger tubes D15 and D16, and a portion between the heat exchanger tubes D19 and D110. Here, from the viewpoint of making effective use of the space in the cabinet, the front heat exchanger is notched to form three parts, and the front heat exchanger is arranged arcuately along the outer periphery of the blower 5. As a result, as thermal separation means, the heat exchanger tubes 15 and 16 are thermally separated from each other by an arrangement such that the windward portions of the fins 1 are notched along the air flow direction by about half the fine width. Furthermore, by forming notches for thermally separating the portion between the refrigerant outlet 18 and a high-temperature portion in an overheated area, i.e., a portion between the fins 1 in close contact with the heat exchanger tube 16 and the fins 1 in close contact with the heat exchanger tube 17, heat exchanger performance can be improved. Thermal separation between the starting part of the one-path portion R1 where the refrigerant is entering a supercooled state, and the refrigerant outlet 18 makes it possible to thermally separate heat exchanger tubes through which refrigerant portions mutually having a large temperature difference flow, and eliminate thermal loss, thereby resulting in an improved thermal exchange performance.

Figure 17:
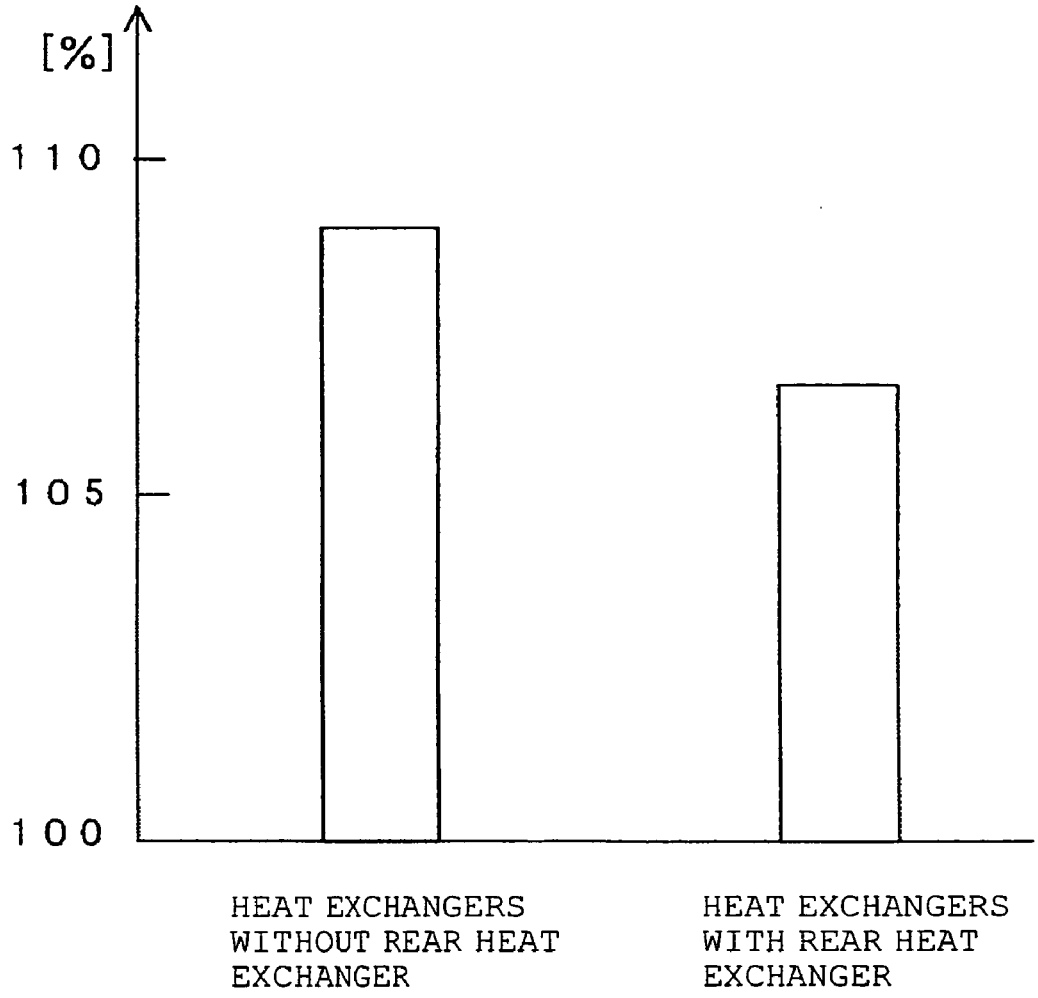
FIG. 17 is a graph showing a heat exchanger capability according to the first embodiment of the present invention.

FIG. 17 shows increase rates of the heat exchanger capability according to this embodiment with respect to the conventional heat exchanger capability. Here, ordinate axis denotes percentage. In the heat exchangers without a rear heat exchanger, (heat exchange capability during heating operation under perfect countercurrent condition shown in FIG. 10)/(conventional heat exchange capability during heating operation under non-perfect countercurrent condition) is shown. On the other hand, in the heat exchangers with a rear heat exchanger, (heat exchange capability during heating operation under perfect countercurrent condition shown in FIG. 14)/(conventional heat exchange capability during heating operation under non-perfect countercurrent condition) is shown. For both of the heat exchangers with a rear heat exchanger and without a rear heat exchanger, the construction of conventional non-perfect countercurrent scheme is the same as the construction of perfect countercurrent scheme to be here compared, in the fin shape, heat exchanger tube pitch, heat exchanger tube diameter, stage number of heat exchanger tubes, fin pitch, and number of paths, and is arranged to vary the way of refrigerant's flowing in paths in the following manner. The refrigerant flowing through each of the refrigerant channels between the refrigerant inlet and refrigerant outlet flows from the leeward-side row to the windward-side row in the air flow direction; further flows from the windward-side row to the leeward-side row; and again flows from the leeward-side row to the windward-side row.

As shown in FIG. 17, for the heat exchangers without a rear heat exchanger, a capacity increase on the level of 8 to 9% was obtained, and for the heat exchangers with a rear heat exchanger, a capacity increase on the level of 7% was obtained. That is, by arranging so that the refrigerant flowing through each of the refrigerant channels between the refrigerant inlet and refrigerant outlet flows along one direction from the leeward-side row to the windward-side row in the air flow direction in sequence between rows, the effect of increasing the heat exchange capability was obtained for both of the heat exchangers with a rear heat exchanger and without a rear heat exchanger.

FIG. 17 shows that a larger increase in heat exchange capability was obtained in the heat exchanger without a rear heat exchanger than in the heat exchanger with a rear heat exchanger. This is because, in the construction of the indoor unit shown in FIG. 10, the wind amount of the one-path portion in the heat exchanger 15 is larger in the heat exchanger without a rear heat exchanger than in the heat exchanger with a rear heat exchanger, and hence, the heat exchanger without rear heat exchanger can be subjected to a sufficient degree of supercooling. However, the above-described measured values would vary depending on air channels in the indoor unit, i.e., on the layout of various members in the indoor unit and the layout of intake port, blowoff port, etc.

Figure 18:
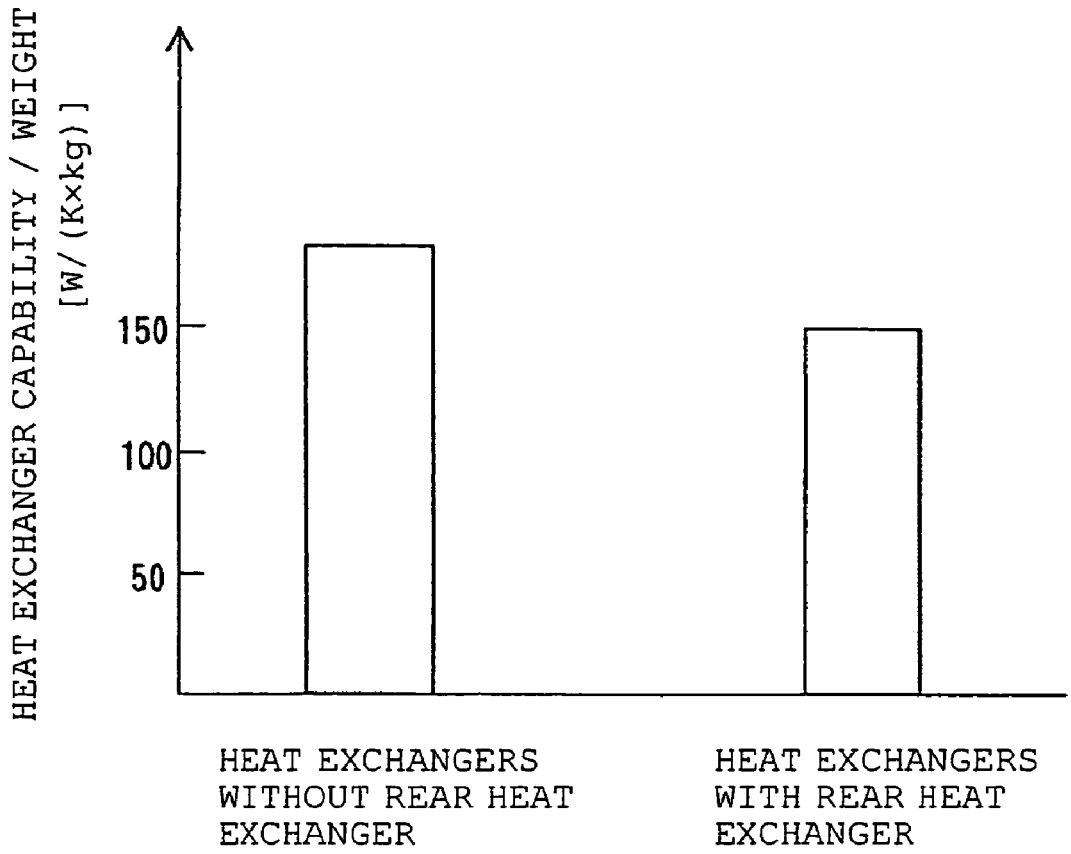
FIG. 18 is a graph showing a heat exchanger capability according to the first embodiment of the present invention.

FIG. 18 is a graph showing heat exchanger capability/weight [W/(K×kg)] in the heat exchanger without a rear heat exchanger and a heat exchanger with a rear heat exchanger. Here, the weight refers to the weight of fins and heat exchanger tubes constituting the heat exchanger, and this heat exchanger capability/weight refers to a heat exchange capability with respect to a weight when the weight is changed by increasing the number of stages of the heat exchanger tubes.

In FIG. 18, when making a comparison regarding heat exchanger capability/weight, it can be seen that the larger capability can be obtained in the heat exchanger without a rear heat exchanger than in the heat exchanger with a rear heat exchanger. This is because, in the construction of the indoor unit shown in FIG. 10, the wind speed on the rear side of the blower 5 is lower, and hence, a large increase in the heat exchange capability such as to be obtained by the front heat exchanger cannot be obtained by the rear heat exchanger. Therefore, when attempting to change the size of the heat exchanger 15 with a construction shown in FIG. 10 or 14, for example, when attempting to increase the number of fins, the number of stages or rows of heat exchanger tubes, the size of fins, etc., the heat exchanger capability can be more improved by upsizing the heat exchanger provided on the front side of the blower 5, than by providing a heat exchanger on the rear side of the blower 5 or upsizing the heat exchanger provided on the rear side of the blower 5.

However, as in the case of the increase rate of heat exchanger capability shown in FIG. 17, the measured value would vary depending on air channels in the indoor unit, i.e., on the layout of various members in the indoor unit and the layout of intake port, blowoff port, etc.

While a construction example wherein a heat exchanger is provided on the rear side of the blower 5, and the heat exchanger is operated as a condenser, was described with reference to FIGS. 14 to 16, the same goes for the case where the heat exchanger is operated as an evaporator. That is, as in the construction in FIG. 14, by configuring a rear heat exchanger so as to surround the blower 5 along with the front heat exchanger; providing a branch portion 20 for partially increase or decrease the number of paths in the refrigerant channel by heat exchanger tubes; and arranging the refrigerant channel so that the refrigerant flowing through each of a plurality of refrigerant channels that are formed to pass through mutually different paths at least at one portion between the refrigerant inlet and the refrigerant outlets, flows along one direction from the windward-side row to the leeward-side row in the air flow direction in sequence between rows, it is possible to make changes in air temperature and in refrigerant temperature substantially parallel and improve heat exchange capability, even when the heat exchanger is operated as an evaporator.

The air flow shown in FIGS. 6 and 10 is calculation results obtained by measured results or simulations in each construction. If the front panel 7 is constructed so as to allow air to pass through it, the air course and air flow change, but whatever construction is used, the windward-side row in the heat exchanger becomes the intake side and the leeward-side row becomes the blowoff side, based on the positional relationship between the heat exchanger 15 and the blower 5. Accordingly, when the heat exchanger is operated as an evaporator, a construction is used in which the refrigerant flowing through each of the refrigerant channels flows along one direction from the windward-side row to the leeward-side row in the air flow direction in sequence between rows, or when the heat exchanger is operated as a condenser, it flows along one direction from the leeward-side row to the windward-side row in the air flow direction in sequence between rows, whereby it is possible to make changes in refrigerant temperature and in refrigerant temperature substantially parallel and enhance heat exchange performance.

When the heat exchanger is used as a condenser, in the forgoing descriptions, the construction in which the number of paths is decreased from two paths to one path has been explained, but this is not restrictive. Constructions in which a plurality of (three or more) paths is decreased into one path may also be used. Also, the present invention is applicable to constructions in which a plurality of (three or more) paths is decreased into a plurality of (two or more) paths.

Furthermore, in the foregoing descriptions, the arrangement having two rows of heat exchanger tubes, i.e., windward-side row heat exchanger tubes and leeward-side row heat exchanger tubes along the air flow direction were used, but arrangements having three rows or more of heat exchanger tubes may also be employed. In this case, the arrangement has only to be configured so that the refrigerant passing through each of the plurality of refrigerant channels between the refrigerant inlet and refrigerant outlet flows along one direction from the leeward-side row to the windward-side row in sequence between rows, e.g., in the case of three rows, in the order of the leeward-side row intermediate row→windward-side row.

Figure 19:
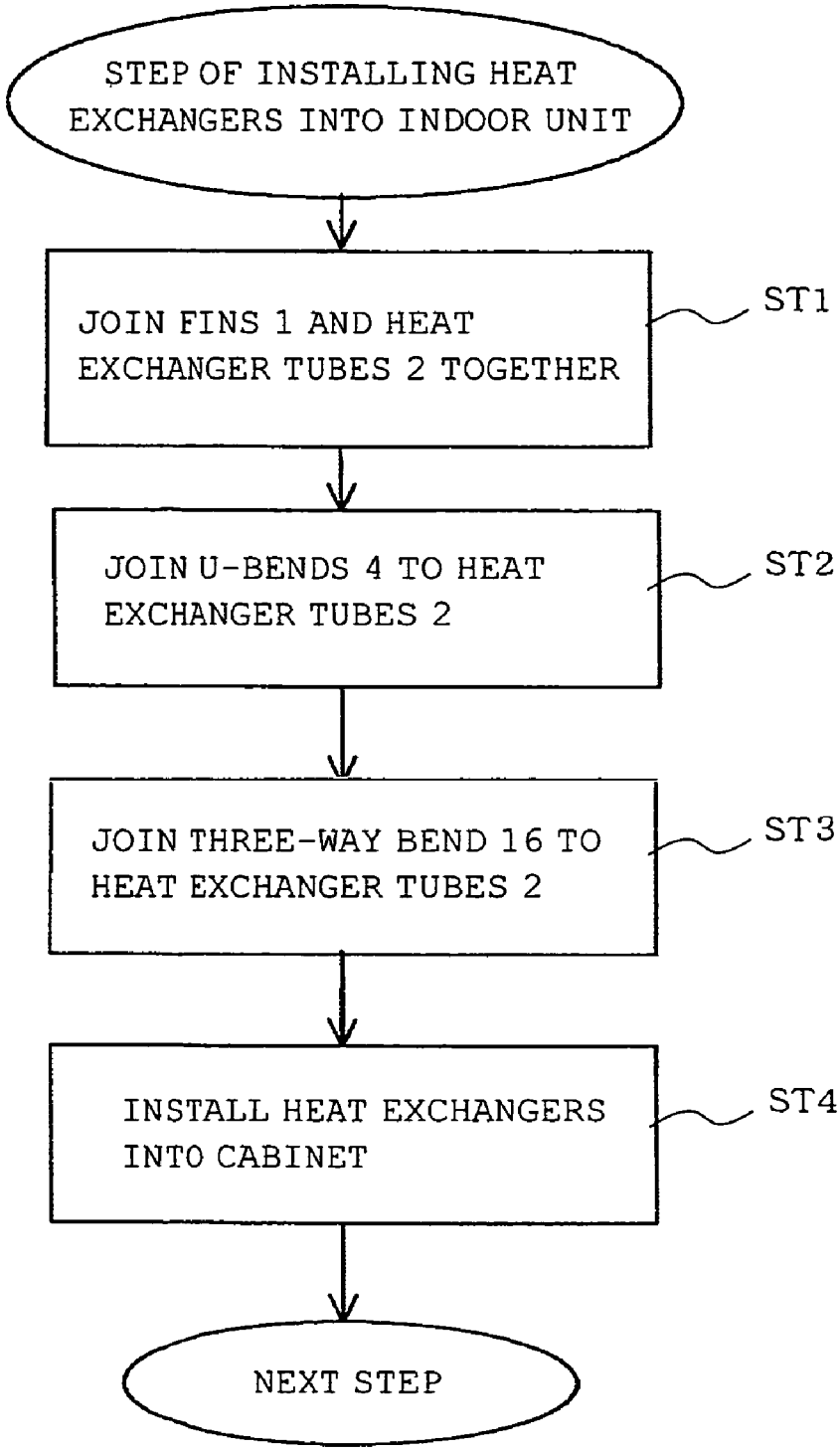
FIG. 19 is a flowchart showing a step of installing heat exchangers into the indoor unit, according to the first embodiment of the present invention.
Figure 20:
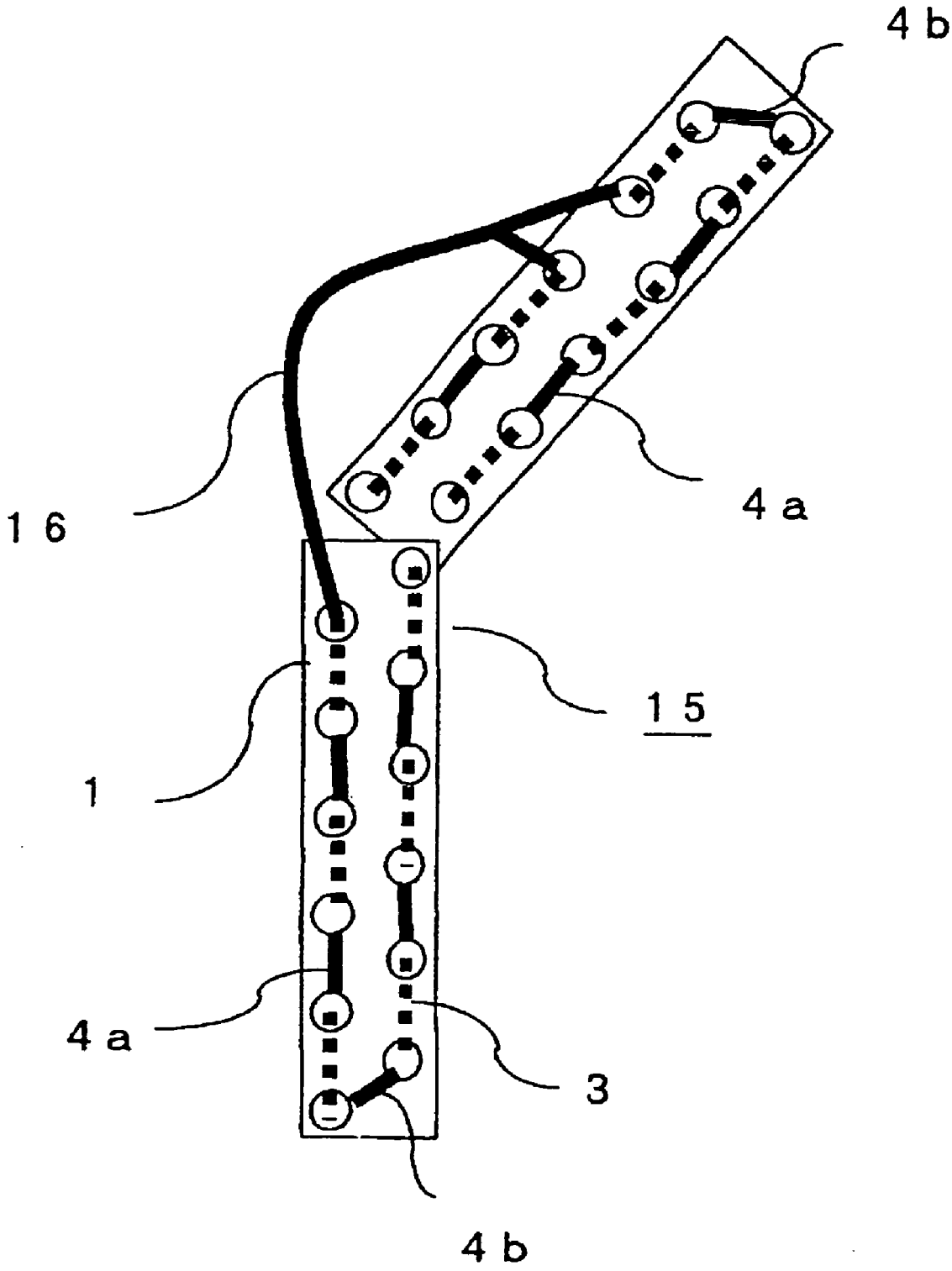
FIG. 20 is an explanatory view showing a state of the heat exchangers in the process of being assembled, according to the first embodiment of the present invention.

FIG. 19 is a flowchart showing an installation process of the heat exchanger in the indoor unit, according to this embodiment, and FIG. 20 is an explanatory view showing a state of the heat exchanger in the process of being assembled before it is installed to the unit frame, according to this embodiment.

According to a conventional step of installing a heat exchanger to an indoor unit, when a fin-tube heat exchanger is formed, firstly hairpins 3 are inserted between layered fins, and the hairpins 3 are brought into close contact with the fins by expanding the tubes. Next, after brazing U-bends 4, the heat exchanger is installed into the cabinet and then the three-way bend 16 is brazed, thereby completing the heat exchanger.

When the heat exchanger is manufactured by such a conventional method, in brazing the three-way bend 16 after the heat exchanger has been installed into the cabinet, the positions 1 of fins constituting the heat exchanger 15 somewhat shift, so that the heat exchanger 15 has not been able to exactly accommodated into the cabinet.

In this embodiment, as shown in FIG. 19, the fins and the heat exchanger tubes are joined together by the tube expansion (ST1), and the U-bends are connected to heat exchanger tubes 2 by, e.g., brazing, thereby performing a heat exchanger tube end connecting step for connecting ends of the heat exchanger tubes 2, two by two (ST2). Then, a branch pipe connecting step for connecting the three-way bend 16 to the heat exchanger tubes 2 by, e.g., brazing is performed (ST3), and thereafter, the heat exchanger 15 is installed into the cabinet (ST4). To install the heat exchanger into the cabinet, the heat exchanger is fixed into the cabinet, e.g., by engaging a hook provided on the cabinet side and a hook provided on the heat exchanger side.

In this manufacturing method, the three-way bend 16 is connected to the heat exchanger tubes 2 before the heat exchanger is installed into the cabinet. Therefore, connection work of the three-way bend 16 is easy, and its connection to the heat exchanger 15 can be reliably performed. Moreover, in this time point, the heat exchanger 15 is in a state near the completion thereof, it is possible to reduce working steps after the heat exchanger 15 has been installed into the cabinet, and prevent the position of the heat exchanger 15 from displacing after having been installed into the cabinet.

Thus, when manufacturing a heat exchanger 15 comprising: heat exchanger tubes 2 that are substantially perpendicularly inserted into a plurality of fins 1 arranged in parallel with each other at a predetermined spacing so as to form a plurality rows along the longitudinal direction of the fins 1, the rows being connected to each other along the gas flow direction to thereby form refrigerant channels between a refrigerant inlet and a refrigerant outlet; and a branch pipe 16 that is connected to the connection portions of the heat exchanger tubes 2, and that partially increases or decrease the number of paths in the refrigerant channels formed by the heat exchanger tubes, it is possible to achieve a method for manufacturing an air conditioner, allowing its heat exchanger 15 to be installed in a cabinet in an easy and accurate manner, by performing a heat exchanger tube end connecting step (ST2) for connecting ends of the heat exchanger tubes that have been inserted into and fixed to the fins 1, on a two-by-two basis, by U-bends serving as connection pipes; a branch pipe connecting step (ST3) for connecting connection pipings 16*a*, 16*b*, and 16*c* of the branch pipe 16 to ends of the heat exchanger tubes 2; and a step of fixing the heat exchanger into a cabinet after the heat exchanger tube end connecting step (ST2) and the branch pipe connecting step (ST3).

In steps shown in FIG. 19, the order of the heat exchanger tube end connecting step (ST2) and the branch pipe connecting step (ST3) may also be reversed. It is essential only that the U-bends 4 and three-way bend 16 are connected to the heat exchanger tubes 2 before the heat exchanger is installed into the cabinet.

Refrigerants for the heat exchanger in the above-described first embodiment, and the air conditioner using it may include HCFC refrigerants, HFC refrigerants, HC refrigerants, natural refrigerants, or refrigerant mixtures of several kinds of refrigerants. Use of any kind of them can achieve its effect. The HCFC refrigerants include R22 etc. The HFC refrigerants include R116, R125, R134*a*, R14, R143*a*, R152*a*, R227*ea*, R23, R236*ea*, R236*fa*, R245*ca*, R245*fa*, R32, R41, RC318, etc, and refrigerant mixtures of several kinds of these refrigerants R407A, R407B, R407*c*, R407D, R407E, R410A, R410B, R404A, R507A, R508A, 508B, etc. The HC refrigerants include butane, isobutane, ethane, propane, propylene, etc., and refrigerant mixtures of several kinds of these refrigerants. The natural refrigerants include air, carbon dioxide, ammonia, etc., and refrigerant mixtures of several kinds of these refrigerants.

As a working fluid, air and a refrigerant has been taken as examples, but use of other gases, liquids, gas/liquid mixture fluids also exerts similar effects.

The materials of heat exchanger tubes and fins are not particularly limited. Materials mutually different between them may be employed. However, use of the identical material, e.g., copper for the heat exchanger tubes and fins, or aluminum for the heat exchanger tubes and fins allows brazing between the fins and heat exchanger tubes. This dramatically enhance contact heat transfer coefficient between the fin portions and heat exchanger tubes, thereby significantly improving heat exchange capability. Simultaneously, recycling efficiency can be enhanced.

A hydrophilic material is usually applied to fins before the heat exchanger tubes and fins are brought into close contact together, but when the heat exchanger tubes and fins are brought into closed contact together by furnace brazing, it is desirable that the hydrophilic material is applied to the fins after the heat exchanger tubes and fins have been brought into close contact together. The application of the hydrophilic material to the fins after the furnace brazing prevents burning-off of the hydrophilic material during the furnace brazing.

By applying a radiation coating for promoting heat transfer by radiation, to plate-shaped fins, heat transfer performance can be improved. Also, by applying a photocatalyst coating to the fins, it is possible to enhance the hydrophilicity of the fins and prevent condensed water from dripping to the blower 5 when the heat exchanger is used as an evaporator.

In the heat exchanger and the air conditioner using it, explained in the above-described first embodiment, any refrigerator oils including mineral oils, alkyl benzene oils, ester oils, ether oils, fluorine oils, and the like can attain their effects, irrespective of whether the refrigerant and the oil are mutually soluble or not.

Although descriptions herein have been made about the indoor unit of air conditioner, the outdoor unit is also configured to have a heat exchanger for exchanging heat between outside air and refrigerant, and a blower. In this case, the arrangement for operating the heat exchanger as an evaporator or a condenser is the same as the foregoing. Therefore, the features in this embodiment can be applied to the outdoor unit, as well.

As described above, the air conditioner according to the present invention has the following effects.

In the air conditioner including a cabinet having an intake port and a blowoff port, and a through-flow blower accommodated in this cabinet, an air-impermeable fixed panel is used for the front side, and there is provided a plurality heat exchangers with fins arranged midway along a wind course from the upper intake grill to the through-flow blower or a wind course from the through-flow blower to the blowoff port. Herein, the heat exchangers include a large number of fins arranged in parallel at a predetermined spacing to allow gas to flow therebetween, and a large number of heat exchanger tubes which are substantially perpendicularly inserted into the fins and inside which a fluid flows. These heat exchangers are generally disposed further toward the front side than the center of the blower, and constituted of upper and lower heat exchangers (along the gravity direction) in which the angle formed by the center lines of heat exchanger tubes is an obtuse angle. When these two heat exchangers are each used as a condenser, the refrigerant channels are constructed so that the refrigerant flow in the upstream direction of air or the direction perpendicular to the air flow from the refrigerant inlet toward the refrigerant outlet, wherein a part of the refrigerant channels is made one path, and the other refrigerant channels are made two paths, as well as the two connection ports in the three-way bend connecting the one-path portion and the two path portions are connected so as to straddle the upper and lower heat exchangers. By virtue of the described features, the present invention allows an air conditioner having a large heat exchange capability to be achieved.

Since the refrigerant outlet portion at the time when the heat exchanger is used as a condenser, and any one of the connection portions of three-way pipe are disposed adjacently to each other, and simultaneously, disposed in mutually different heat exchangers, an air conditioner with a high heat exchange capability can be obtained.

In the present air conditioner, the one-path portion is arranged in the most windward-side row in the air flow direction in an upper portion and at the lowermost portion of the heat exchanger, so that the refrigerant outlet at the time when the heat exchanger is used as a condenser is disposed at the lowermost portion in the gravity direction of the upper heat exchanger; and the length between the branch portion of the three-way bend and its connection portion in the lower side in the gravity direction is made larger than the length of between the branch portion of the three-way bend and its connection portion in the upper side in the gravity direction. This enables an air conditioner with a large heat exchange capability to be achieved.

Since each of the shape of fins, the pitch of heat exchanger tubes, the diameter of heat exchanger tubes, the stage number of heat exchanger tubes, and the pitch of fins of the two heat exchangers is made the same, an air conditioner with a large heat exchange capability can be obtained.

Since the manufacturing procedure is used in which, after the upper heat exchanger and the lower heat exchanger are connected by the three-way bend, they are fixed to the indoor unit, and U-bends are connected thereto, an air conditioner that is easy to assemble can be attained.

REFERENCE NUMERALS

1: fin
2: heat exchanger tube
3: hairpin
4: U-bend
5: blower
6: blowoff port
7: front panel
8: intake port
9: blower motor
10: compressor
11: indoor heat exchanger
12: outdoor heat exchanger
13: expansion valve
14: channel switching valve
15: heat exchanger
16: branch pipe
18: windward-side row refrigerant port
19*a* and 19*b*: leeward-side row refrigerant ports
20: branch portion
21: separation means

The invention claimed is:

1. An air conditioner comprising:

a blower for introducing a gas that flows into the air conditioner from an intake port, into a blowoff port;

a heat exchanger for exchanging heat between the gas and a refrigerant, the heat exchanger being disposed on the intake side of the blower and including a first heat exchanger and a second heat exchanger that are divided;

heat exchanger tubes disposed in the heat exchanger, the heat exchanger tubes being substantially perpendicularly inserted into a plurality of fins, the heat exchanger tubes arranged in parallel with each other with a predetermined spacing along the direction of the rotational axis of the blower so as to form rows along the longitudinal direction of the fins, and being connected to each other along the gas flow direction in a plurality of rows, to thereby form refrigerant channels between a refrigerant inlet and a refrigerant outlet; and a branch pipe that is connected to a connection portion of the first heat exchanger in series between the refrigerant inlet and the refrigerant outlet, one branch of the branch pipe connected to the first heat exchanger and another branch of the branch pipe connected directly to the second heat exchanger, the branch pipe partially increases or decreases the number of paths in the refrigerant channels formed by the heat exchanger tubes, wherein the refrigerant flowing through each of a plurality of the refrigerant channels passing through paths mutually different in at least one portion between the refrigerant inlet and the refrigerant outlet, flows along one direction from a windward-side row to a leeward-side row, or from the leeward-side row to the windward-side row in the gas flow direction, in sequence between rows.

2. The air conditioner according to claim 1, wherein either one of the refrigerant inlet and the refrigerant outlet is provided in a heat exchanger tube located at a central portion of the most windward-side row; the other of the refrigerant inlet and the refrigerant outlet is provided in a heat exchanger tube located at a central portion of the most leeward-side row; and a heat exchanger tube located at the end of the most leeward-side row in the longitudinal direction is connected to a heat exchanger tube in a row adjacent to the most leeward-side row.

3. The air conditioner according to claim 1, wherein that the branch pipe has connection pipings to be connected to three or more of the heat exchanger tubes; and the branch pipe is configured so that a pressure loss at a time when the refrigerant flows through a connection piping connecting with a heat exchanger tube located on a lower side in a gravity direction, out of connection pipings connected to a heat exchanger tube on a downstream side in the case of increasing the number of paths, becomes larger than a pressure loss at a time when the refrigerant flows through a connection piping connecting with a heat exchanger tube located on an upper side in the gravity direction.

4. The air conditioner according to claim 3, wherein a length of the connection piping connecting with the heat exchanger tube located on the lower side of the branch pipe in the gravity direction is made larger than the length of the connection piping connecting with the heat exchanger tube located on the upper side of the branch pipe in the gravity direction.

5. The air conditioner according to claim 1, wherein the branch pipe can increase or decrease the number of paths with a one-path portion and plural-path portions; and the heat exchanger tubes constituting the one-path portion are disposed in the most windward-side row in the gas flow direction.

6. The air conditioner according to claim 5, wherein, when the heat exchanger is operated as a condenser, the refrigerant channel is reduced from the plural-path portions into the one-path portion; and the fins in close contact with the heat exchanger tube of the refrigerant outlet are thermally separated from the fins in close contact with the heat exchanger tube located closest to the refrigerant outlet, out of heat exchanger tubes located at the most downstream position of each of the plural-path portions.

7. An air conditioner comprising:

a blower for introducing a gas that flows into the air conditioner from an intake port, into a blowoff port;

a heat exchanger for exchanging heat between the gas and a refrigerant, the heat exchanger being disposed on the intake side of the blower and including a first heat exchanger and a second heat exchanger that are divided;

heat exchanger tubes disposed in the heat exchanger, the heat exchanger tubes being substantially perpendicularly inserted into a plurality of fins, the heat exchanger tubes arranged in parallel with each other with a predetermined spacing along a direction of a rotational axis of the blower so as to form rows along a longitudinal direction of the fins, and being connected to each other along a flow direction of the gas in a plurality of rows, to thereby form refrigerant channels between a refrigerant inlet and a refrigerant outlet;

a branch pipe that is connected to a connection portion of the first heat exchanger in series between the refrigerant inlet and refrigerant outlet, one branch of the branch pipe connected to the first heat exchanger and another branch of the branch pipe connected directly to the second heat exchanger, the flow of the refrigerant from a windward-side row refrigerant port provided to a heat exchanger tube located in a central portion of the most windward-side row with respect to the gas flow direction to a leeward-side row refrigerant port provided to a heat exchanger tube located in a central portion of the most leeward-side row with respect to the gas flow direction; and separation means for thermally separating the fins vertically in the longitudinal direction of the fins at least on the upstream side of the gas flow, wherein at least one portion of the heat exchanger tubes in the most windward-side row is constituted of the one path; and wherein fins in close contact with the heat exchanger tube located in the vicinity of the windward-side row refrigerant port, and fins in close contact with heat exchanger tubes connected with the other branch of the branch pipe, are thermally separated from each other.

8. The air conditioner according to claim 7, wherein the heat exchanger disposed on the front side of the blower is constructed by arranging the two heat exchangers in a chevron shape, the two heat exchangers having fin shapes substantially equal to each other.

9. The air conditioner according to claim 7, wherein the first and second heat exchangers are constituted of an upper heat exchanger and a lower heat exchanger, respectively, that are vertically divided; a refrigerant outlet at a time when the heat exchanger is operated as a condenser is disposed in a heat exchanger tube located at the lowest position in the gravity direction, of the upper heat exchanger; and at least one connection piping connected upstream of a refrigerant flow, out of the connection pipings of the branch pipe, is disposed in the lower heat exchanger.

10. The air conditioner according to claim 1, wherein the heat exchanger disposed on the front side of the blower is constructed by arranging the first and second heat exchangers in a chevron shape, the two heat exchangers having fin shapes substantially equal to each other.

11. The air conditioner according to claim 1, wherein the first and second heat exchangers are an upper heat exchanger and a lower heat exchanger, respectively, that are vertically divided; a refrigerant outlet at the time when the heat exchanger is operated as a condenser is disposed in a heat exchanger tube located at the lowest position in the gravity direction, of the upper heat exchanger; and at least one connection piping connected upstream of a refrigerant flow, out of the connection pipings of the branch pipe, is disposed in the lower heat exchanger.

12. An air conditioner comprising:

a blower for introducing a gas that flows into the air conditioner from an intake port, into a blowoff port;

a heat exchanger for exchanging heat between the gas and a refrigerant, the heat exchanger being disposed on the intake side of the blower and including an upper heat exchanger and a lower heat exchanger that are divided;

heat exchanger tubes disposed in the heat exchanger, the heat exchanger tubes being substantially perpendicularly inserted into a plurality of fins, the heat exchanger tubes arranged in parallel with each other with a predetermined spacing along the direction of the rotational axis of the blower so as to form rows along the longitudinal direction of the fins, and being connected to each other along the gas flow direction in a plurality of rows, to thereby form refrigerant channels between a refrigerant inlet and a refrigerant outlet; and a three-way branch pipe having a first connection portion connected to a connection portion of the upper heat exchanger in series between the refrigerant inlet and the refrigerant outlet, a second connection portion connected to the upper heat exchanger and a third connection portion of the branch pipe connected directly to the lower heat exchanger, the branch pipe forming a one path portion and a two path portion, the one path portion being constituted from a plurality of heat exchanger tubes which are in a vicinity of the lowermost portion in a most windward side row in the upper heat exchanger, the first and second connection portions of the branch pipe being connected to two heat exchanger tubes of the heat exchanger tubes in the most windward side row in the upper heat exchanger, and the third connection portion of the branch pipe being connected to one heat exchanger tube of the heat exchanger tubes in the most windward side row in the lower heat exchanger, the refrigerant inlet being the heat exchanger tube of the lowermost portion in the most windward side row in the upper heat exchanger when the heat exchanger is used as an evaporator, and the refrigerant outlet is the heat exchanger tube of the lowermost portion in the most windward side row in the upper heat exchanger when the heat exchanger is used as a condenser, wherein the refrigerant flowing through each of a plurality of the refrigerant channels passing through paths mutually different in at least one portion between the refrigerant inlet and the refrigerant outlet, flows along one direction from a windward-side row to a leeward-side row, or from the leeward-side row to the windward-side row in the gas flow direction, in sequence between rows.

* * * * *